US005857910A

United States Patent [19]

Watanabe et al.

[11] Patent Number: 5,857,910

[45] Date of Patent: Jan. 12, 1999

[54] GAME MACHINE USING OBJECT PIECES SUSPENDED IN LIQUID

[75] Inventors: Katsuhiko Watanabe, Zama; Masanori Suganuma, Yokohama; Yoshihito Kato; Takashi Yamaguchi, both of Zama, all of Japan

[73] Assignee: Konami Co., Ltd., Hyogo-ken, Japan

[21] Appl. No.: 922,150

[22] Filed: Sep. 2, 1997

[30] Foreign Application Priority Data

Sep. 3, 1996 [JP] Japan ..... 8-232763
Dec. 10, 1996 [JP] Japan ..... 8-329807

[51] Int. Cl.[6] ..... A63F 3/06

[52] U.S. Cl. ..... 463/17; 463/19; 463/46; 273/138.5; 273/138.2; 273/144 R; 273/144 B; 273/457

[58] Field of Search ..... 273/138.5, 138.3, 273/138.2, 138.1, 144 B, 144 R, 145 C, 145 CA, 457, 269; 463/17, 19

[56] References Cited

U.S. PATENT DOCUMENTS 5,050,882 9/1991 Yang ..... 273/144 B
5,634,639 6/1997 Tokito et al. ..... 273/123 R
5,743,526 4/1998 Inoue ..... 273/144 R

FOREIGN PATENT DOCUMENTS 1181452 2/1970 United Kingdom ..... 273/144 B
2244930 12/1991 United Kingdom ..... 273/457

*Primary Examiner*—Benjamin H. Layno
*Attorney, Agent, or Firm*—Jordan and Hamburg

[57] ABSTRACT

A game machine has an input section through which a player inputs various instructions necessary for the play. The input section also displays various kinds of game information and performs computation of the score. The machine also has a mechanical section which includes a tank having a transparent wall and filled with water, a plurality of balls suspended in the water, a central tubular structure for creating a central upward flow of water, a liquid supply portion including a nozzle under the tubular structure, and an information reading unit disposed in a peripheral region of the tank through which the balls fall down due to, for example, difference in the specific gravity between the ball and the water. A rotary guide rail is disposed in the peripheral region so as to catch the falling balls. Any ball which leaves the lower end of the guide rail is received by the information reading unit, on condition that the lower end of the guide rail opposes the information reading unit at the very moment at which the ball leaves the lower end of the guide rail. Specific information peculiar to the ball is read by the information reading unit which has a magnetic sensor. The player is allowed to visually observe the state of shuffling of the ball by the circulating water, as well as the state of the balls entering the information reading unit.

25 Claims, 21 Drawing Sheets

GAME MACHINE USING OBJECT PIECES SUSPENDED IN LIQUID

BACKGROUND OF THE INVENTION

1. Field of the Invention

The present invention relates to a game machine of the type in which M pieces of object are extracted in a random manner out of N pieces of the object (M<N) each carrying information peculiar thereto, and scores are gained in accordance with the conditions created by the combination of pieces of information carried by the extracted pieces of object. More particularly, the present invention is concerned with a novel construction for extracting the pieces of object so as to enhance the fun of the game.

2. Description of the Related Art

Hitherto, such a bingo game machine has been proposed as having a rotary cage for shuffling a plurality of balls therein, a ball hopper for receiving the shuffled balls, a ball receptacle for receiving the balls one by one from the ball hopper and allowing the received ball to drop, a detector for temporarily holding the bold and detecting a numeral carried by the ball, and a ball pool into which balls after the detection of the numerals are introduced through a conduit and pooled therein. The bingo game machine also has a game display which displays a bingo card having a matrix of predetermined numerals arranged in a random manner. Coincidence of the numerals detected from the balls with the numerals arranged on a vertical, horizontal or diagonal line of the bingo card is regarded as a "win". Different scores are set for different natures or degrees of the "win". A predetermined number of medals are paid to the player in accordance with the score on the "win" gained by the player. This type of bingo game machine is disclosed, for example, in Japanese Patent Laid-Open No. 6-71010.

In the game machine of the type described above, different numerals are given to different balls and these balls are shuffled by a large bulbous rotary cage so that the balls are extracted one by one in a random manner. Since the balls are shuffled during a given rotary motion of the cage, it is difficult for the player to visually trace the behavior of independent balls. At the same time, an impression is imparted that there is no room at all for the player to exert his own skill and experience in the game. Consequently, this known bingo game machine is unsatisfactory in that it cannot offer sufficient stage effect which would enhance fun and amusement of the play. In addition, selection of the balls is progressively restricted because the balls which have been selected and detected are stored in the ball pool, without being subjected to repeated selection.

SUMMARY OF THE INVENTION

Accordingly, it is an object of the present invention to provide a game machine in which shuffling of a plurality of object pieces is conducted by circulating the object pieces in a circulating liquid, so that the object pieces under shuffling can be visually traced by the player, thus enhancing the stage effect by imparting an impression as if the player can control the game by using his own technique.

To this end, according to one aspect of the present invention, there is provided a game machine of the type in which M pieces of object are extracted in a random manner out of N pieces of the object (M<N) each carrying information peculiar thereto, and scores are gained in accordance with the conditions created by the combination of pieces of information carried by the extracted pieces of object, the game machine comprising: tank means having a tank with a transparent wall and containing a liquid suspending the N pieces of object; liquid circulation generating means for generating a vertical circulation of the liquid in the tank; and information reading means disposed in the tank at a portion of a plane which intersects the path of circulation of the liquid, and for extracting a piece of the object to read the information carried by the piece of object when the piece of object passes the above-mentioned portion of the plane.

According to this arrangement, a plurality of pieces of object are moved in the path of the liquid circulation while being shuffled momentarily. The information reading means disposed at a position in a plane intersecting the liquid circulation path reads the information carried by any piece of object which has happened to pass through the information reading means. Thus, reading of information is not performed for the pieces of object which have passed positions in the above-mentioned plane other than the position of the information reading means. According to the invention, the piece of the object which has passed through the information reading means is again put into the circulating liquid, so that there is a possibility that the same ball is detected repeatedly. When reading of the information carried by the M pieces of object is finished, a score is given based on the relationships between the pieces of information acquired from the extracted pieces of object. Since the pieces of object are allowed to move in the circulating liquid while being shuffled without restriction, the player can visually observe and trace the behavior of the object pieces and confirm whether the object is being extracted.

In accordance with a second aspect of the present invention, there is provided a game machine of the type in which M pieces of object are extracted in a random manner out of N pieces of the object (M<N) each carrying information peculiar thereto, and scores are gained in accordance with the conditions created by the combination of pieces of information carried by the extracted pieces of object, the game machine comprising: tank means having a tank with a transparent wall and containing a liquid having a specific gravity smaller than that of the object; liquid circulation generating means for generating a circulation of the liquid such that an upward flow of the liquid is formed on a portion of the bottom of the tank so that the pieces of object staying on the bottom of the tank are forcibly conveyed upward by the upward flow of the liquid and then falls down through a region around the upward flow; and information reading means disposed in the tank at a specific portion of the region around the upward flow, and for extracting a piece of the object to read the information carried by the piece of object when the piece of object passes the above-mentioned specific portion of the region.

In this game machine, a plurality of pieces of object are conveyed upward by the upward flow of the liquid while being shuffled, and are then scattered radially outward. The pieces of object then falls through the region around the upward flow of the liquid, by the force of gravity or by the downward flow of the circulating liquid. The information reading means are disposed in the region around the upward flow of the liquid, i.e., in a region in which the circulating liquid flows downward. Consequently, the information reading means extracts or fails to extract, in a random manner, the pieces of object which are falling in the above-mentioned region. All the pieces of object, regardless of whether they have been extracted by the information reading means or not, are collected at the bottom, and are moved upward again along the upward flow of the circulating liquid. During this upward movement, the pieces of object are allowed to behave freely so that shuffling is conducted in a random manner. The player can visually observe and conform whether one of the pieces of object falling down in the liquid passes through the information reading means which is situated at the specific portion of the region in which the liquid moves downward.

The liquid circulation generating means may include an upward flow passage tube disposed on the center of the bottom of the tank and defining a passage for the upward flow of the liquid, and a liquid supply means for forcing the liquid into the upward flow passage tube through the lower end of the upward flow passage tube. Thus, the pieces of object are forced to ascend through the upward flow passage tube while being shuffled in a random manner.

The game machine may further comprise a spiral guide member disposed between the transparent wall of the tank and the wall of the upward flow passage tube and progressively changing its diameter from the top to the bottom ends thereof. Most pieces of object falling down along with the circulating liquid are caught by the spiral guide member so as to further fall downward while rolling along the spiral guide member, so that the movement of the pieces of object is stabilized to enhance the chance of extraction.

The object may be a ball, and the spiral guide member may include a pair of coaxial spiral linear members which are spaced from each other by a distance not greater than the diameter of the ball. This arrangement increases the chance for the object pieces falling down at various locations in the downward flow of the liquid to be caught by the spiral guide member.

The spiral guide member may be rotated about its axis which extends vertically. According to this arrangement, the rotation of the spiral guide member serves to vary the position at which the object is released from the spiral guide member, so that not all of the object pieces rolling down along the guide member pass through the reading position. Consequently, the random nature of the object extraction is enhanced to offer a greater fun of the game.

The liquid supply means may have a pump which sucks the liquid from the region around the upward flow passage tube and forces the sucked liquid into the upward flow passage tube. With this arrangement, it is possible to obtain a stable circulating flow of the liquid, since the pump sucks the liquid coming down and discharges the liquid to create the upward flow.

The liquid circulation generating means may include an upward flow passage tube disposed on the center of the bottom of the tank and defining a passage for the upward flow of the liquid, and a liquid supply means for forcing the liquid into the upward flow passage tube through the lower end of the upward flow passage tube. The liquid supply means may include a sub-tank selectively communicatable with the tank by means of valves such that the liquid is shiftable between the tank and the sub-tank. With this arrangement, the liquid may be displaced from the tank to the sub-tank and vice versa, so that the interior of the game machine becomes accessible for the purpose of maintenance or other work, by shifting the liquid from the tank to the sub-tank.

Each piece of the object has peculiar information transmitting means which may be embedded therein, and the reading means has a proximity sensor capable of sensing the information peculiar to each piece of object transmitted by the information transmitting means. By virtue of the use of the proximity sensor, information can be read without fail despite the fact that the object and the sensor are disposed in the liquid.

Preferably, the peculiar information transmitting means includes at least two, more preferably three, identical information carriers which are arranged to extend in orthogonal directions so that information is sensed from at least one of the information carriers depending on the posture of the piece of object passing through the reading means. Thus, the peculiar information carried by the extracted object can be read without fail, regardless of the posture or orientation of the object which freely falls down in the liquid.

The reading means includes one or more reading units arranged along the path of rotation of the lower end of the spiral guide member such that each reading unit can receive a piece of the object freed from the lower end when the lower end has been rotated to a position where it opposes the reading unit. Thus, the object can be extracted only when the lower end of the guide member is positioned to face the information reading means, at the moment at which the object leaves the lower end of the spiral guide member. This enhances the random nature of the object extraction, particularly when a plurality of information reading means are disposed along the path of the lower end of the rotating spiral guide member.

In the game machine of the present invention, the object after the reading of the information therefrom is again returned to the circulating flow of the liquid, as stated before. This is achieved by suitable means including the means for collecting the piece of object after reading of information together with other pieces of object and putting these pieces together to the flow of the liquid.

The object may have a specific gravity which is smaller than that of the liquid. In such a case, the liquid circulation generating means includes means for creating downward flow of the liquid in tank, so that the object gradually falls due to difference between the buoyancy and the force exerted by the downward flow of the liquid.

The N pieces may have an equal specific gravity or may have different values of specific gravity.

In order that the information is read without fail, the game machine may further comprise means for allowing the extracted piece of object to stay in the information reading means for a predetermined period of time.

When the spiral guide member is used, the diameter of the guide member is progressively changed such that the difference in diameter between adjacent turns of the spiral form is substantially equal to the diameter of the object.

The information peculiar to each piece of object may include one or both of color information and number information. Such information may be magnetically readable information or optically readable information.

Preferably, an anti-jump member is provided above the aforesaid upward flow passage tube so as to prevent the pieces of object conveyed by the upward flow of the liquid from jumping above the liquid surface in the tank.

It is also preferred that the game machine further comprises an annular protrusion formed on the bottom of the tank where the pieces of object are collected, so as to surround the upward flow passage tube, thus holding the pieces of object slightly above the bottom, and perforations provided around the protrusion and communicating with the liquid supply portion, so as to apply upward flow of the liquid to the pieces of object from the lower side of the pieces of object.

The above and other objects, features and advantages of the present invention will become clear from the following description of the preferred embodiments taken in conjunction with the accompanying drawings.

DESCRIPTION OF THE PREFERRED EMBODIMENT

Figure 1:
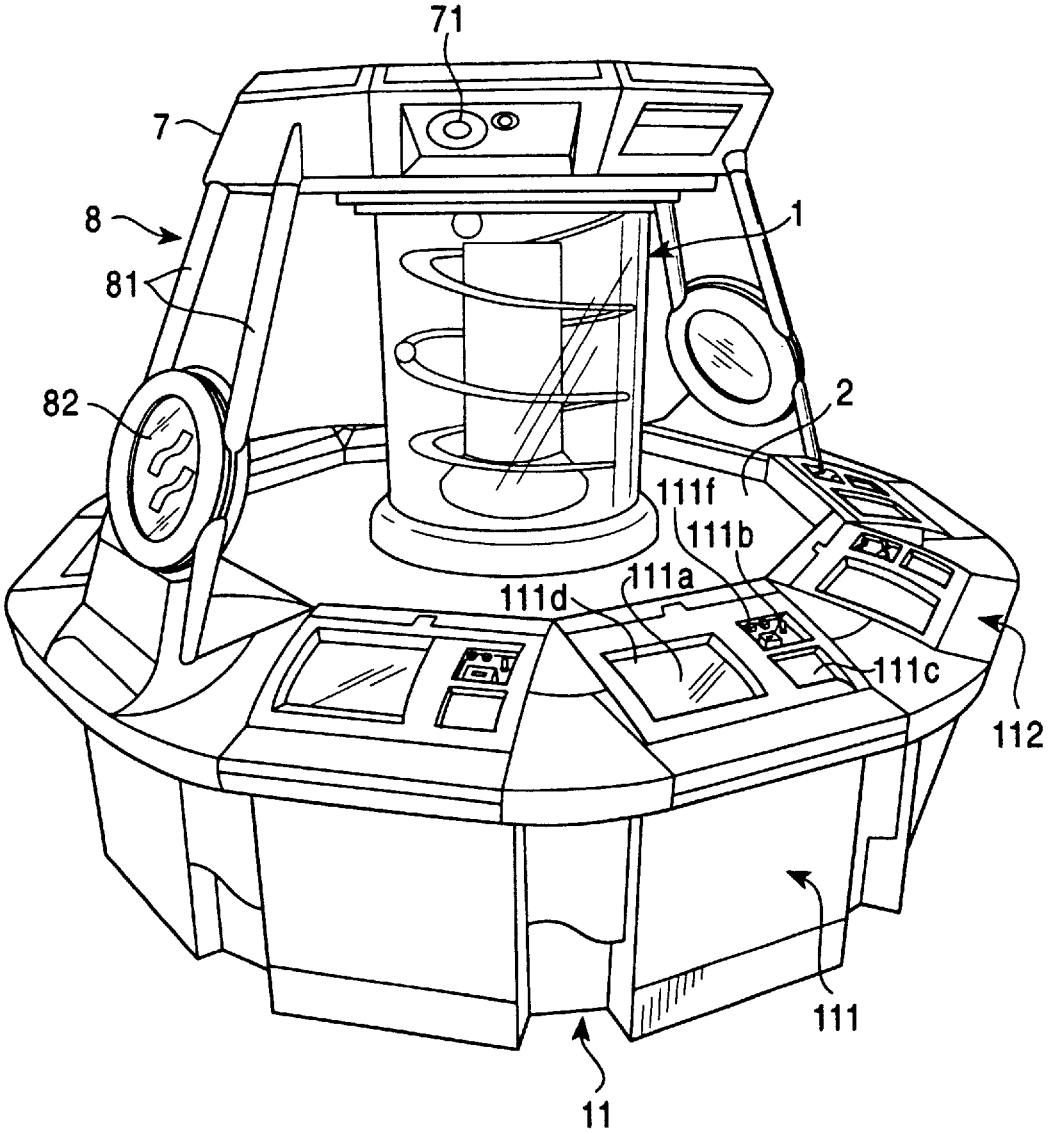
FIG. 1 is a perspective view of a game machine in accordance with the present invention.
Figure 2:
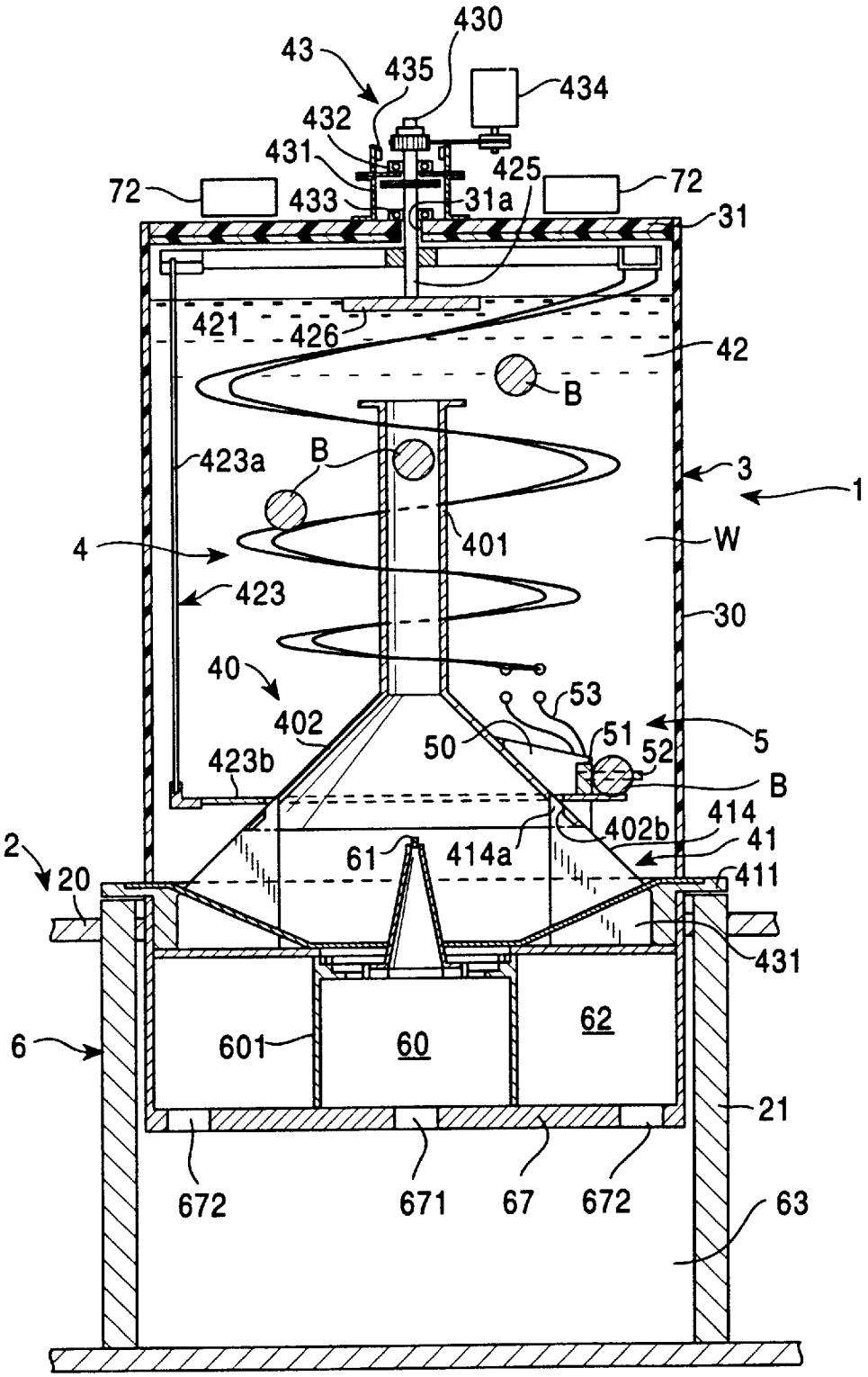
FIG. 2 is a schematic front elevational view of a mechanical section of the game machine.

FIG. 1 is a schematic perspective view of a game machine in accordance with the present invention, while FIG. 2 is a front elevational view of a mechanical section of the game machine, schematically illustrating the construction of the mechanical section. The illustrated game machine, which is usable as a bingo game machine, has a central mechanical section 1 and a peripheral input section 11. Although FIG. 1 shows only front side of the machine, the whole machine has an identical arrangement both at its front and rear sides. The game machine also employs a predetermined number of balls B.

Figure 6:
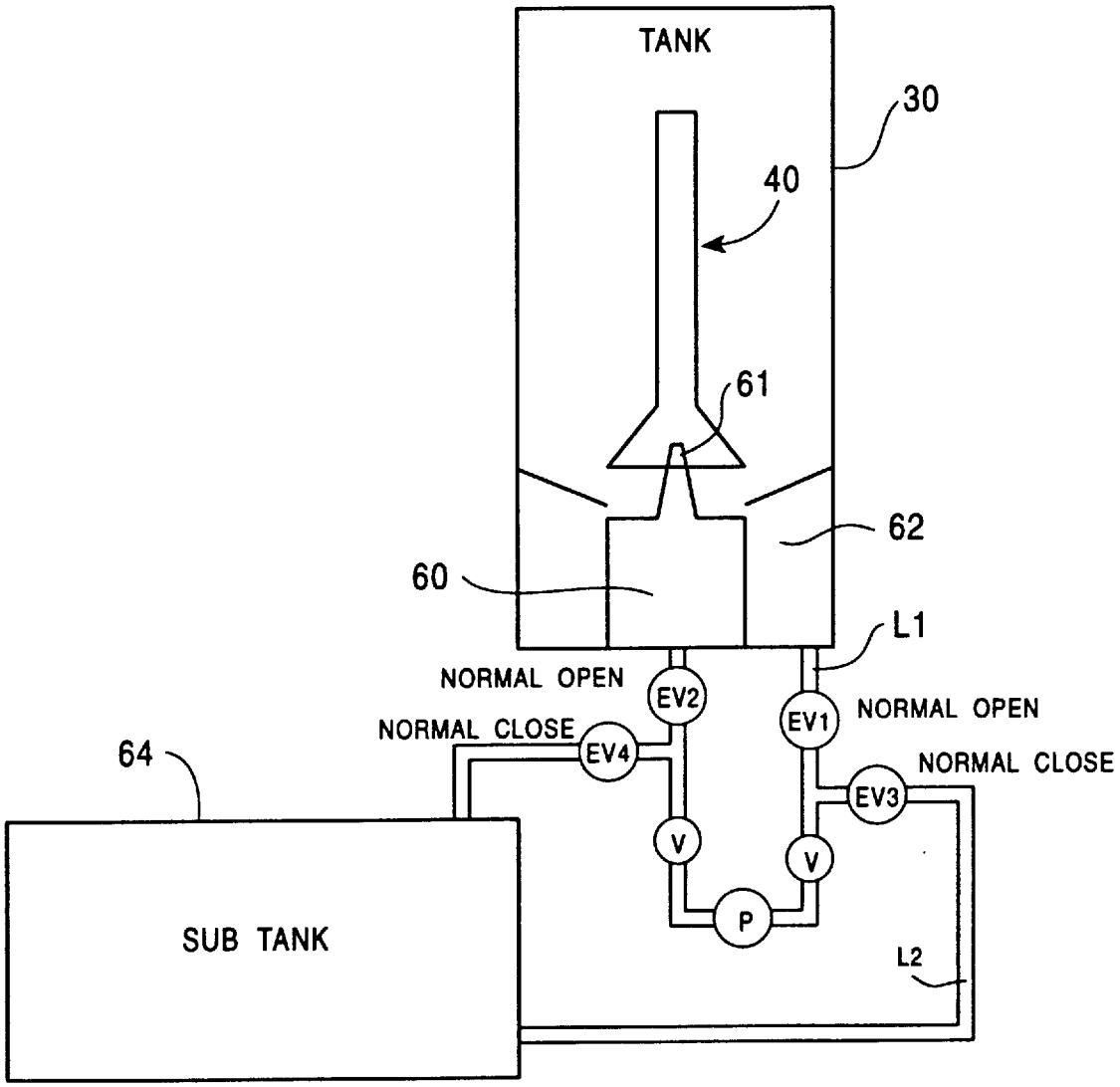
FIG. 6 is a piping diagram showing the piping of the liquid supply portion.

As will be seen from FIG. 2, the mechanical section 1 has a base portion 2, a central portion 3 standing upright from the top center of the base portion 2, a crown portion 7 serving as a ceiling of the central portion 3, and left and right support portions 8. The top face of the base portion 2 has a flat annular area which is made of, for example, a plate member which provides a white flat surface 20. A sub-tank 64 is disposed inside the base portion 2 as shown in FIG. 6. The central portion 3 has a cylindrical tank 30 which contains a predetermined quantity of a liquid having a specific gravity smaller than that of the ball B, e.g., water W. A shuffling portion 4 for creating circulation of the liquid and a reading portion 5 for reading information peculiar to the ball B are disposed inside the tank 30. Although not shown in FIG. 1, a liquid supply portion 6 (see FIG. 2) is disposed under the tank 30. Conduits L1, L2, a pump P, electromagnetic or solenoid valves EV1 to EV4 (see FIG. 6), which in cooperation constitute the liquid supply portion 6, are arranged in the remainder part of the space inside the base portion 2.

The crown portion 7 provided on the top of the tank 30 has a substantial diameter, and carries visual information such as words expressing the contents of the game, as well as a speaker 71 which produces a certain type of acoustic effect. As will be described later, driving section 43 which constitute a part of the shuffling mechanism 4 is disposed at the center of the crown portion 7. A plurality of tank interior lighting portions 72 are disposed at an inner peripheral part of the crown portion 7 at a constant circumferential spacing. In the illustrated embodiment, there are three lighting portions 72.

Each support 8 has a bed 80 which is disposed at a left or right side portion of the base portion 2, a pair of parallel arms 81 which are fixed to the bed 80 and the crown 7, and an illuminating portion 82 fixed to the parallel arms 81. Light projecting units 9 are attached to the lower side of the crown portion 7 both at left and right side portions of the same, so as to apply beams of light to the aforementioned annular flat white surface 20 in a manner like searchlights.

The input section 11 surrounds the base portion 2 and has a plurality of game terminals 111, 112 and so on arranged in a symmetrical manner. In the illustrated embodiment, four terminals are arranged on the front side and four on the rear side of the game machine. All these terminals have an identical construction.

The construction of the terminal will be described with reference to the terminal 111 by way of example. The terminal 111 has a display portion 111*a* constituted by, for example, a CRT for displaying various kinds of information such as the content of the game, operation menu and so forth, a medal supply portion 111*b* adjacent to the display portion 111*a* and a medal payoff portion 111*c* under the medal supply portion 111*b*. The arrangement is such that predetermined numbers of medals are paid to the player in accordance with the scores gained in the game. Predetermined numbers of medals, corresponding to the scores gained, are counted by a payoff unit (not shown) inside the machine and are paid from a medal box (not shown) inside the machine.

A game format such as of a bingo card is electronically displayed on the display portion 111*b* which also gives information and instructions necessary for prosecuting the game by means of menus. The player can make a direct access to the menu through a transparent touch panel 111*d* superposed on the display portion 11*a*.

The touch panel 111*d* is a two-dimensional tabular device having an X-Y plane and made of a material which permits supersonic wave to propagate therethrough. A supersonic wave generator is arranged along one of two sides parallel to the X-axis so as to cyclically transmit supersonic wave towards the other side. Similarly, a supersonic wave generator is disposed along one of opposing sides parallel to the Y-axis so as to cyclically transmit supersonic wave towards the opposing side. When a player's finger touches at an appropriate portion of the panel, the supersonic wave is reflected at the position touched by the finger, so that the position of the finger touching the panel can be located on the X-Y coordinates by calculating the time until the reflected supersonic waves reach respective supersonic generators. The coordinates of the position of the finger touch and the coordinates of the menu is suitably correlated, so that the machine understands what portion or item on the display has been selected by the player.

FIG. 2 is a front elevational view of the mechanical section 1, schematically illustrating the construction thereof. The shuffling portion 4 has a tubular structure 40, an annular support 41 in support of the tubular structure 40, a sinking ball guide portion 42 between the tubular structure 40 and the tank 30, and a driving unit 43 for rotating the sinking ball guide portion 42.

The tubular structure 40 has an upper part constituted by a cylindrical passage portion 401, and a lower part constituted by a frusto-conical return portion 402. These upper and lower parts may be formed integrally, or may be formed separately and then united such that a cylindrical hub 402*a* (see FIG. 4) on the upper end of the return portion 402 fits in the passage portion 401.

The annular support 41 includes an annular member 411 which is fixed to the upper ends of a predetermined number of pillars 21 arranged along a circle and standing upright inside the base portion 2 and which carries the tank 30; a slant surface 412 which spreads radially inward from the annular member 411, a plurality of reinforcement ribs 413 arranged radially on the lower side of the annular member 411 so as to reinforce the latter, and a plurality of supporting ribs 414 standing upright from the slant surface 412. The slant surface has an inside diameter as measured at its bottom which is about ⅓ the inside diameter of the tank 30. The supporting ribs 414 have slant sides which are substantially flush with the slant surface of the return portion 402. Projections 414*a* formed on the upper ends of the supporting ribs 414 engage with corresponding anchor holes 402*b* formed in the return portion 402, whereby the tubular structure 40 is supported by the supporting ribs 414. A clearance of a size which is large enough to allow the ball B to pass therethrough is defined between the lower end edge of the return portion 40 of the tubular portion 40 and the slant surface 412 of the support 41. A predetermined number of balls B can be accommodated in a space defined by the shapes of the return portion 402 and the slant surface 412, as well as by the size of the clearance between them.

The upper end opening of the tank 30 is closed by a cover 31 which is constituted by a single sheet of glass or an acrylic resin or by a laminate structure composed of such a glass or acrylic resin sheet and another acrylic resin sheet superposed on the center of the first-mentioned sheet where the driving unit 43 is mounted. The driving unit 43 has a rotary shaft 430 which extends through a shaft hole 31*a* formed in the center of the cover 31. The driving unit 43 has, besides the rotary shaft 430, various components such as a supporting tube 431, upper and lower bearings 432, 433 which respectively support the upper and lower portions of the rotary shaft 430, and a motor 434 which drives the rotary shaft 430 through, for example, a belt transmission. The driving unit 43 also has a pair of rotation angle sensors 435 which are operative to sense the angle of rotation of the rotary shaft 430 to control the rotation. Each rotation angle sensor 435 includes, for example, a photo-interrupter which detects passage of a radial projection projecting from a suitable portion of the rotary shaft 430. These sensors 435 are arranged to diametrically oppose each other and performs also monitoring of the rotation direction.

A horizontal rotation arm 421 is fixed to the lower end of the rotary shaft 430 for rotation therewith. A spiral guide rail 422 composed of a pair of coaxial spiral pipes is attached to one end of the rotation arm 421, while a gate member 423 depends from the other end of the rotary arm 421. The distance between the pair of pipes constituting the guide rail 422 is somewhat smaller than the diameter of the ball B, so that the ball B can "sink" while rolling along the guide rail 422. The diameter of the spiral guide rail 422 progressively decreases towards the lower end, such that the diameter of a turn of the spiral form is smaller than that of the overlying turn by an amount which is substantially equal to the gap between the pair of pipes. Such a progressive change of the spiral diameter maximizes the chance for the sinking ball to be caught by a portion of the spiral guide rail 422. The lower end of the guide rail 422 is positioned at a level which is just above the level of the reading portion 5 disposed on a suitable portion of the slant surface of the return portion 402, so that, as will be described later, a ball B leaving the lower end of the guide rail 422 passes through a reading position in the reading portion 5, whereby the ball B is "extracted". The guide rail 422 rotates at a period of several seconds to ten and several seconds, and the ball B is allowed to enter the reading portion 5 to pass through the reading position only when the timing at which the ball B leaves the lower end of the guide rail 422 coincides with the timing at which the lower end of the guide rail 422 opposes the reading portion 5. Although the diameter of the spiral guide rail 422 progressively decrease downward, this is not exclusive and the diameter may progressively increase towards the lower end.

Figure 3:
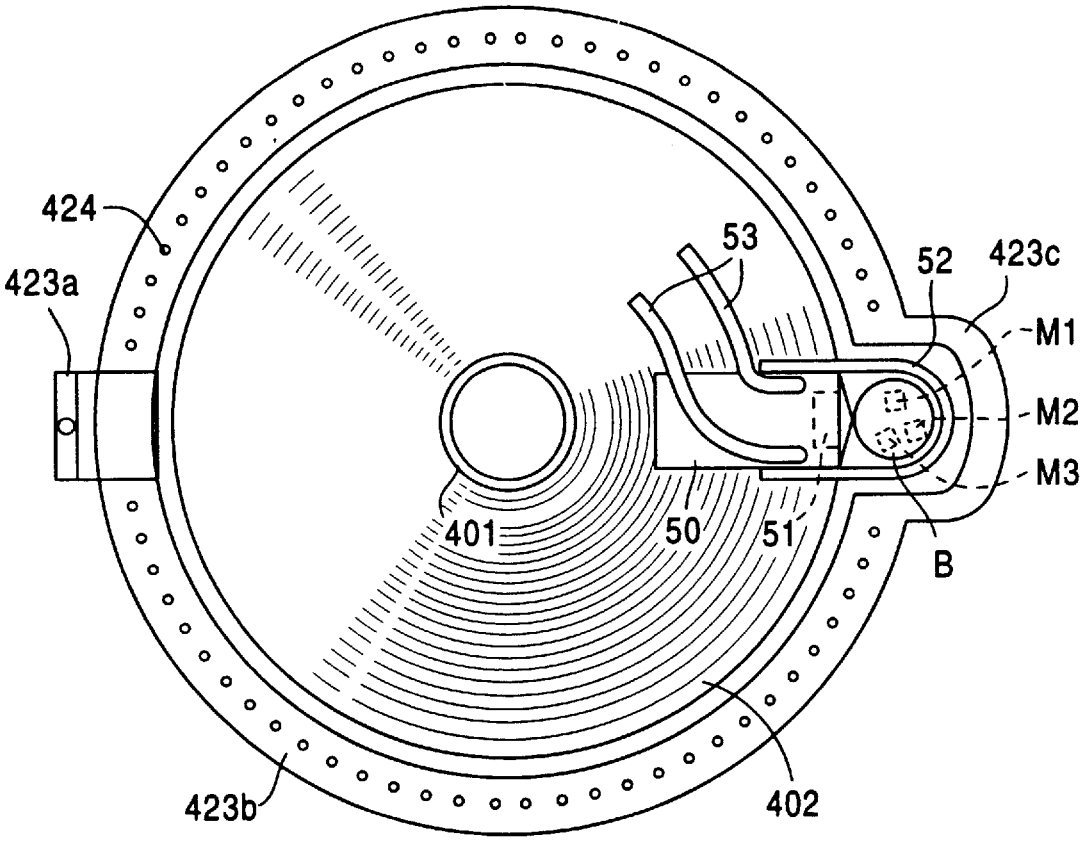
FIGS. 3 and 4 are a plan view and a side view of a reading section of the game machine.
Figure 4:
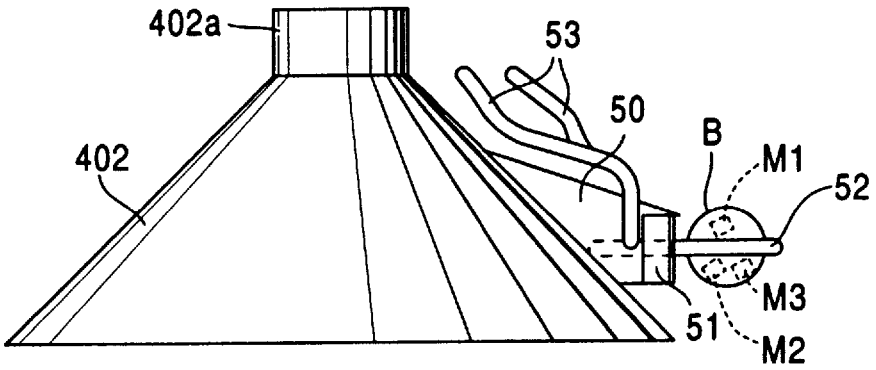

As will be seen from FIGS. 3 and 4, the reading portion 5 includes a sensor body 50, a sensor element 51 and a ring 52 provided on the sensor body 50, the sensor ring 52 being horizontally oriented and having a diameter greater than that of the ball B, at the smallest. The sensor element 51 may be a magnetic sensor sensitive to magnetism, and includes a reading coil which is disposed to oppose the ring 52 and which serves as a magnetic head. When a ball B has been extracted, i.e., when a ball B passes through the ring 52, the sensor element 51 works as a proximity sensor which senses magnetic codes produced by magnetic code generating members M1, M2 and M3 embedded in the ball B. More specifically, these three magnetic code generating members M1, M2 and M3 are arranged to extend in three directions which are orthogonal to one another and produce magnetic codes in the directions of their axes in synchronization, thus realizing magnetic anisotropy or non-directivity of the ball. In the illustrated embodiments, balls of three different colors are used, 10 balls for each color. The magnetic code generating members M1 to M3 embedded in each ball B generate a code corresponding to the color of the ball, e.g., red, blue or yellow, and a code corresponding to numeral, e.g., one of numbers from 0 to 9. Thus, the sensor element 51 is capable of sensing the magnetic codes generated by one of the three code generating members M1 to M3, regardless of the posture of the ball B passing through the ring 52 and serves as proximal sensor which reads the information carried by the codes. Consequently, the construction for reading information is much more simplified as compared with the case where the ball is held mechanically and read by a code reader after the ball posture is verified.

The ball B having the three identical magnetic code generating members M1 to M3 embedded therein to extend in three orthogonal directions may be substituted by a ball which has only two such magnetic code generating members M1 and M2 which are arranged to extend in different directions, preferably in directions orthogonal to each other. The ball B loosely held by the ring 52 irregularly rolls on a later-mentioned rotating gate plate 423*b* such that the axis of rotation of the ball fluctuates in a random manner, so that the magnetic codes can be read from at least one of the two magnetic code generating members. In order to ensure the safe reading of the magnetic codes, the upper surface of the gate plate 423*b* may have an irregular ramp or the like, so that the ball turns and rolls about arbitrary axis. When such random turning and rotation of the ball is obtained, the magnetic codes may be read safely even when only one magnetic code generating member is used, considering that the ball B is held on the gate plate 423*b* for a time which is long enough to ensure the safe reading even from a single magnetic code generating member.

The reading portion 5 further has a receiving guide 53 disposed above the sensor body 50. The receiving guide 53 is composed of a pair of pipes which are arranged side by side leaving therebetween a gap which is slightly smaller than the diameter of the ball B. These pipes have their upper ends disposed at a level just below the locus of the rotation of the guide rail 422. When a ball B leaves the lower end of the guide rail 422 while the latter has just been rotated to oppose the upper end of the receiving guide 53, the ball B is received by the receiving guide 53 to roll therealong into the ring 52.

A gate member 423 which depends from the rotary arm 421 has a vertical arm 423*a* and the above-mentioned horizontal annular gate plate 423*b* secured to the vertical arm 423*a*. The lower end of the vertical arm 423*a* is set at a level which is lower by a half diameter of the ball B than the level of the ring 52. As will be seen from FIG. 3, the gate plate 423*b* has a C-shape which is formed by cutting a circumferential part out of an annular member by a length equal to or slightly greater than the diameter of the ring 52. Thus, the gate plate 423*b* prevents the ball B received in the ring 52 from sinking, so that the ball B is temporarily held in the ring for a certain period during which the magnetic codes of the ball B are read. As a result of rotation of the gate plate 423*b*, the cutout portion of the gate plate 423*b* is brought to a position right below the ring 52 to allow the ball B to fall. The size of the cutout portion is determined to be large enough to permit the ball to pass through the cutout portion which is being rotated. The portion of the gate plate 423*b* other than the cutout portion serves to hold the ball B for a predetermined time of period so as prevent any subsequent ball B released from the end of the guide rail 422 from being extracted, thus offering random nature of ball extraction, while minimizing a chance for any ball B sinking downward by the force of gravity without rolling along the guide rail 422 to directly fall into the ring for extraction, thus enhancing the fun of the game.

Although the illustrated embodiment has only one reading portion 5, this is only illustrative and the game machine of the invention may have two symmetrically arranged reading portions or three or more reading portions arranged preferably at a constant circumferential pitch. It is not essential that such a plurality of reading portions 5 are arranged symmetrically or at a constant circumferential pitch. However, reading portions 5 which are arranged in close proximity of each other increase the chance that successive balls B rolling down along the guide rail 22 are successively extracted by these reading portions 5, thus impairing the random nature of the ball selection. The use of a plurality of reading portions 5 realizes distribution of the positions of ball extraction, thus enhancing the random nature of the ball selection and rendering the game more interesting, while giving stimulating effect to the play.

The rotary shaft 430, rotary arm 421 and the gate member 424 have continuous bore or conduit formed therethrough which opens in a plurality of tiny holes 424 perforated in the upper face of the gate plate 423*b*. Compressed air is supplied into the conduit from an air compressor (not shown) having a compressed air outlet connected to the upper end of the rotary shaft 430. The air is released from the tiny holes 424 of the gate plate 423*b* so as to form upward flow of tiny air bubbles. A plurality of tank interior lighting portions 72 are disposed right above the gate plate 423*b*. In the illustrated embodiment, four such tank interior lighting portions 72 are employed so that light beams of different colors including white are projected onto the upward flow of the air bubbles, thus giving a high stage effect.

Figure 5:
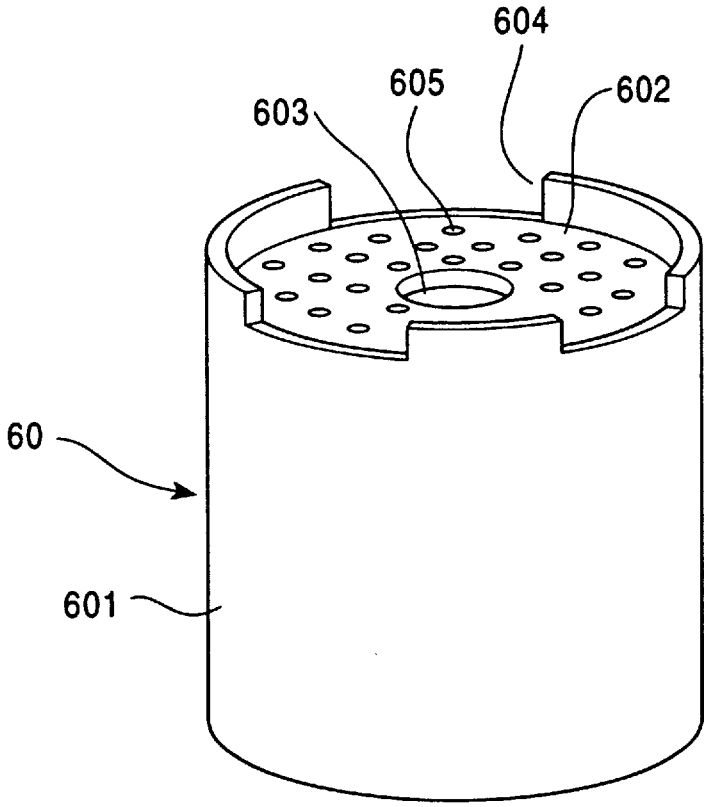
FIG. 5 is an illustration of the construction of a discharge tube of a liquid supply portion.

A description will now be given of the construction and operation of the liquid supply portion 6, with specific reference to FIGS. 2, 5 and 6. The liquid supply portion 6 is disposed below the slant surface 412, and has a discharge tube 60, a nozzle 61, a suction tube 62, and a liquid supply driving unit 63 which is shown in FIG. 6. Referring to FIG. 6, the liquid supply driving unit has a pump P, conduits L1, L2 and a plurality of solenoid valves EV1 to EV4, and is equipped with a sub-tank 64 having a capacity equal to or greater than that of the tank 30.

The liquid supply driving unit 63 is disposed in a lowermost space of the base section 2. The central discharge tube 60 and the suction tube 62 surrounding the discharge tube 60 are formed on a partition plate 67 disposed above the liquid supply driving unit 63. As will be best seen from FIG. 5, the discharge tube has a ceiling 602 in which is formed a central hole 603. The peripheral cylindrical wall 601 extends upward beyond the ceiling 602 over a predetermined axial length. The extension of the peripheral wall 601 is cutout at suitable circumferential positions to provide a plurality of cutouts 604 each providing a predetermined opening area. The upper end brim of the extension of the peripheral wall of the discharge tube 60 abuts the lower surface of the radially innermost portion of the base plate 411 of the support 41. The peripheral wall 61 of the discharge tube 60 serves also as the inner peripheral wall of the suction tube 62. An upwardly converging nozzle 61 is attached to the ceiling 602 of the discharge tube 60 so as to cover the hole 603. The partition plate 67 has a central hole 671 and a pair of holes 672 formed at suitable portions in a peripheral region of the partition plate 67. According to this arrangement, the space around the nozzle 61 communicates through the cutouts 604 with the space in the suction tube 62 which in turn communicates with a liquid inlet of the liquid supply driving unit 63 through the peripheral holes 672. At the same time, an outlet of the liquid supply driving unit 63 communicates through the central hole 671 with the space inside the discharge tube 60 which in turn communicates with the space inside the nozzle 61 through the hole 603. In operation, water W delivered by the pump P into the discharge tube 60 is discharged from the nozzle 61 to form an upward flow of water W through the return portion 402 and the cylindrical passage portion 401. The upward flow of water W is freed from the upper end of the cylindrical passage portion 401 to diverge radially outward and then flows downward towards the cutouts 604.

The total area of the cutouts 604 is so determined that the water W passes through these cutouts 604 at a velocity which is smaller than the velocity of the upward flow of water from the nozzle 61, so that the downward flow of the water does not produce any substantial downward force which would act on the returning balls B. Balls which have fallen onto the ceiling 602 of the discharge tube 60 are attracted by the upward flow of water created by the nozzle 61, whereby a circulation of balls B takes place through the sink passage between the tubular structure 40 and the wall of the tank 30. Water is discharged also through a plurality of small holes 605 formed around the central hole 603 at a constant radial distance from the center of the discharge tube 60, so that upward flow of water created by the water discharged from these small holes 65 serves to lift the balls B on the ceiling 602 to a level where the balls B are easily caught by the upward flow created by the nozzle 61, whereby stagnation of balls B on the ceiling 602 is avoided.

Referring specifically to FIG. 6, the liquid supply driving unit 63 has a pipeline L1 which interconnects the hole 671 and the holes 672. The conduit L1 has the solenoid valve EV1, valve V, pump P, valve V and the solenoid valve EV2 are disposed in the conduit L1 sequentially in the order from the end adjacent to the holes 672, i.e., from the upstream end, to the end adjacent to the hole 671, i.e., the downstream end. The liquid supply driving unit 63 also has a conduit L2 branching from a portion of the conduit L1 between the solenoid valve EV1 and the valve V and which leads to an inlet of the sub-tank 64. The conduit L2 also includes a portion which leads from an outlet of the sub-tank 64 and merges in the conduit L1 at a portion of the latter between the valve V and the solenoid valve EV2. The portion of the conduit L2 leading to the inlet of the sub-tank has the solenoid valve EV3, while the portion leading from the outlet of the tank 64 has the solenoid valve EV4. The pair of valves V in the conduit L1 are used for the purpose of regulating or adjusting the flow rate of the water during the playing.

During the playing, the solenoid valves EV1 and EV2 are opened, while the solenoid valves EV3 and EV4 are closed. As the pump P operates, water W circulates through the solenoid valve EV2, hole 671, inside the tank 30, holes 672 and then through the solenoid valve EV1.

Supply or draining of the liquid inside the machine for the purpose of maintenance or renewal of the liquid is conducted as follow. For the purpose of draining, the pump P is operated, with the solenoid valves EV1 and EV4 kept open and the solenoid valves EV2 and EV3 kept closed, so that the water W inside the tank 30 is displaced into the sub-tank 64 via the suction tube 62, holes 672, solenoid valve EV1, pump P and the solenoid valve EV4, whereby the tank 30 is drained to enable an efficient work inside the tank 30 for the purpose of, for example, maintenance. For the purpose of filling the machine with water again, the pump P is operated with the solenoid valves EV2 and EV3 opened and the solenoid valves EV1 and EV4 closed, so that the water W inside the sub-tank 64 is returned to the tank 30 via the solenoid valve EV3, pump P, solenoid valve EV2, holes 672, discharge tube 60, hole 603 and the nozzle 61.

A description will now be given of the operation for extracting the ball B, as well as of the operation for reading the magnetic codes. Thirty (30) balls are charged in the machine together with the predetermined quantity of water W. As the pump P starts to operate, upward flow of water is created through the nozzle 61 to cause the water to ascend through the tubular structure 40. At the same time, water is discharged also from the small holes 605 to lift the balls B stagnant on the ceiling 602 to the level of the outlet of the nozzle 61 and are caught by the upward flow of water from the nozzle so as to ascend through the tubular structure 40. The balls B which have been relieved from the upper end of the tubular structure 40 are conveyed radially by the flow of water which spread radially outward towards the wall of the tank 30. The balls B then starts to slowly sink due to difference in the specific gravity. Sinking balls B picked up by the rotating guide rail 422, i.e., the balls which have fallen onto the guide rail 422, then rolls down along the guide rail 422 so as to be released from the lower end of the guide rail 422. The spiral form of the guide rail 422 and the slow speed of rotation of the same provides a large credibility that the sinking balls B fall onto the rotating guide rail 422. When the timing at which a ball B leaves the lower end of the guide rail 422 coincides with the timing at which the lower end of the rotating guide rail 422 is positioned right above the receiving guide 53, the ball B is introduced into the reading portion 5 so as to be extracted by being read. Balls B which leave the lower end of the guide rail 422 when the lower end of the guide rail 422 is out of alignment with the receiving guide 53 are allowed to roll down along the slant surface 412, without being extracted, and are lifted by the upward flow of water discharged from the small holes 605 to the level of the end of the nozzle 61, so as to be forced into the tubular structure 40 to circulate again through the described path of ball circulation. There are balls, although few, which fall down directly to the level of the reading portion 5 without being picked up by the rotating guide rail 422. These balls B also are circulated without being extracted, in the manner described above.

The extracted ball B is held by the land portion of the gate plate 423*b* so a to stay in the ring 52 for a predetermined period of time, and the magnetic codes of the ball B are read by the sensor element 51 during the stay. The gate is opened as the gate plate 423 has been rotated to bring its cutout portion to the position right below the ring 52, so that the ball B falls towards the slant surface 412. Thus, the extracted ball B also is fed into the tubular structure 40 together with the balls B which have not been extracted. The described operation is continued until the pump P is stopped when the game is over, i.e., when a predetermined number of balls B have been extracted.

A description will now be given of the light projecting units 9, with specific reference to FIGS. 7 to 9. As will be seen from FIG. 7, the pair of light projecting units 9 are provided on the lower part of the head portion 7 at left and right portions of the latter, so as to project light beams onto the white flat surface of the base portion 2 in a manner like searchlights.

Figure 7:
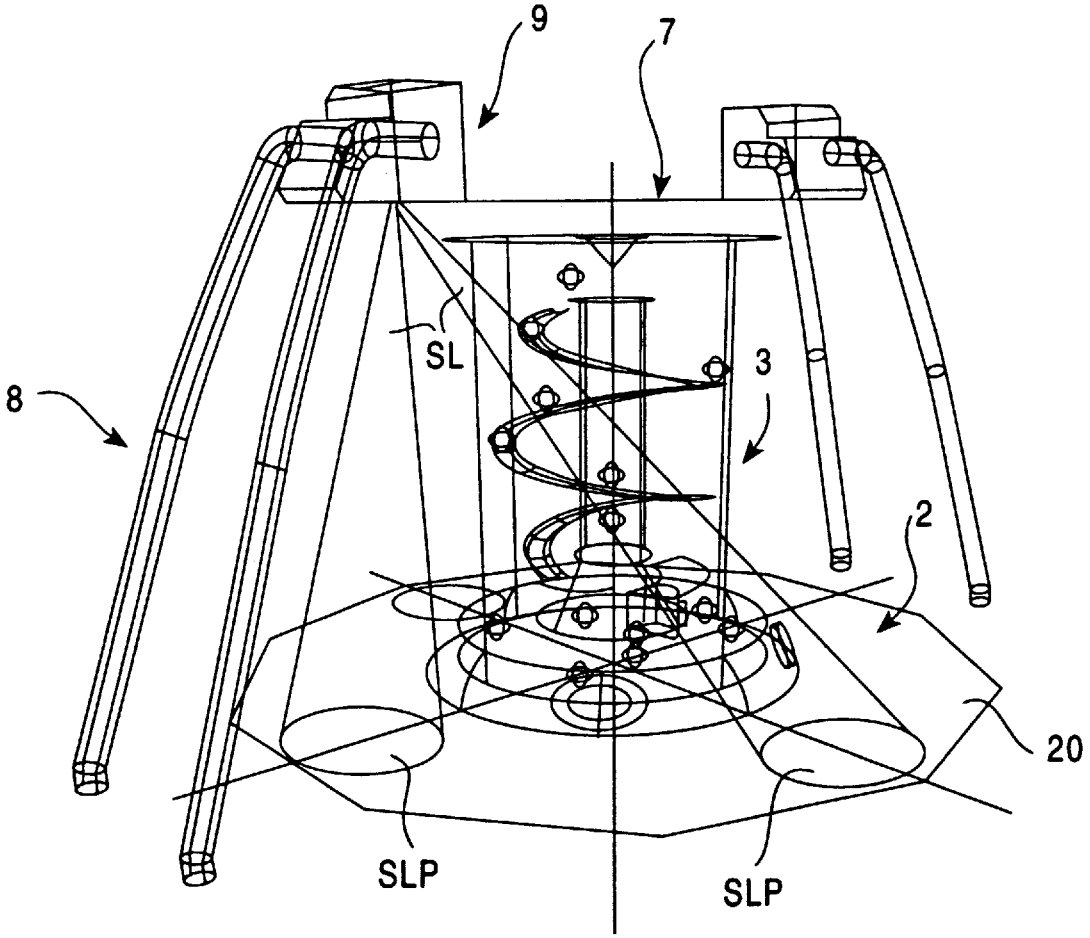
FIG. 7 is a schematic illustration of the game machine showing the positional relationships of the base portion, central structure, crown and light projecting units.

FIG. 7 schematically illustrates the positional relationships between the base portion 2, central portion 3, crown 7 and the light projecting units 9. One of the light projecting units 9 is attached to lower left side portion, while the other is attached to lower right side portion, of the crown 7. For the purpose of simplification of the drawings, only the left light projecting unit 9 is shown in FIG. 7. A spot light beam SL of a predetermined beam diameter is applied onto the annular white flat surface 20 on the base portion 2. The light projecting unit 9 has a swivel mechanism which swivels the unit 9 such that the position SLP of the spotlight SL oscillatorily or reciprocately move along the annular white flat surface 20.

Figure 8:
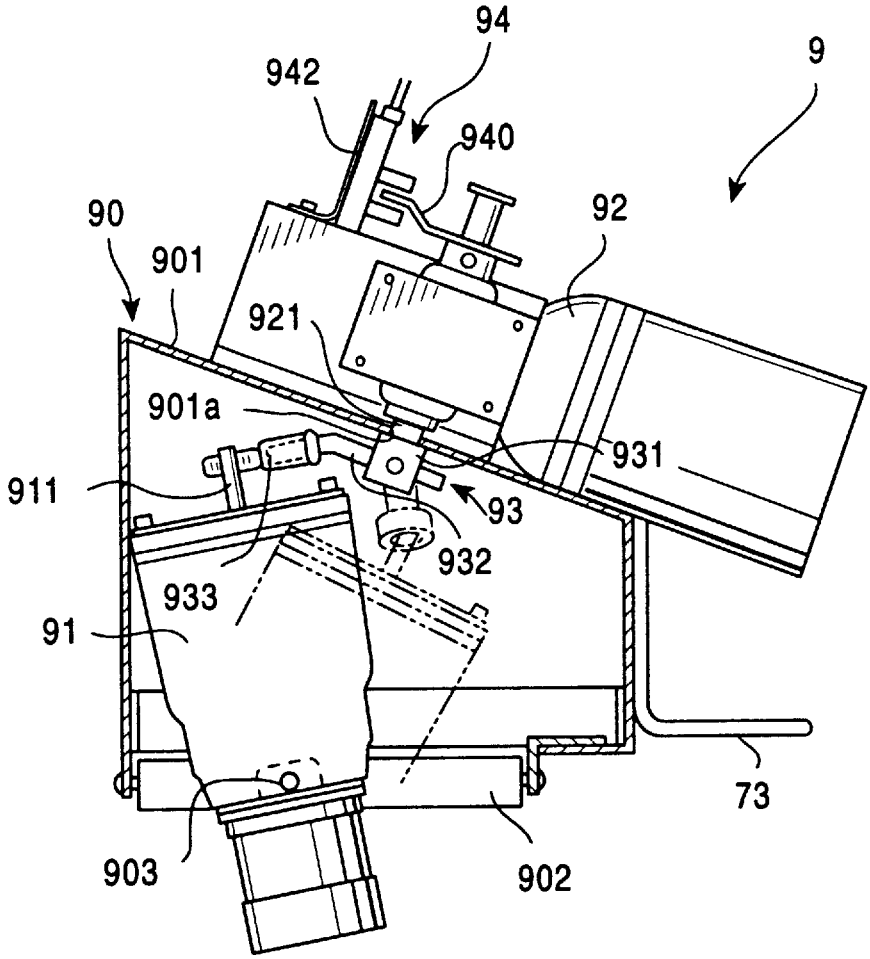
FIG. 8 is an illustration of the construction of a swivel mechanism for causing swivelling motion of a light projecting unit.
Figure 9:
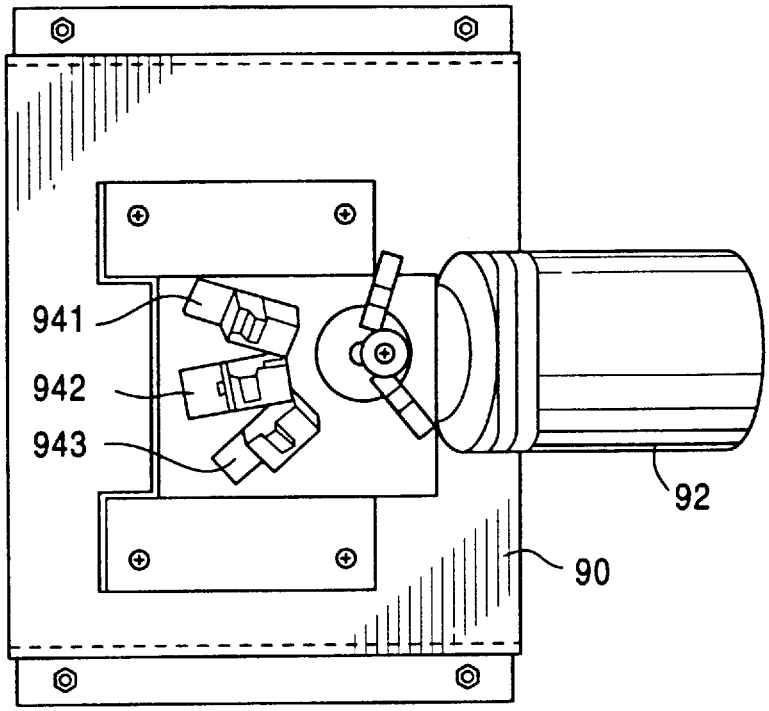
FIG. 9 is an illustration of the light projecting unit as viewed from the upper side thereof.

FIGS. 8 and 9 show the detail of the swivel mechanism. As will be seen from these Figures, the swivel mechanism has a bracket 90 which is fixed to a member 73 which in turn is fixed to the crown 7. The swivel mechanism further has, inside the bracket 90, a swivel light projector 91, a swivel motor 92 for causing swiveling motion of the light projector 91, a swivel mechanism 93 for converting the rotation of the shaft of the swivel motor 92 into the swivelling motion of the light projector 91, and a swivel angle sensor 94. The bracket 90 has a box-like structure formed of a top plate and four side plates, with the bottom opened downward. The top plate 901 of the bracket 90 is slanted so as to descend towards the right end as viewed in FIG. 8. A frame member 902 having a rectangular frame of a size slightly smaller than the bottom opening of the bracket 90 is swingably secured to the left and right side plates of the bracket 90 at a position midst between the front and rear side plates, i.e., at the center of the bracket 90 in the direction normal to the sheet of the drawing of FIG. 8, for a swinging motion.

The light projector 91 has a cylindrical casing which is closed at its upper end and which accommodates a light source (not shown) and a lens (not shown) disposed at the opposite side of the light source to the closed upper end of the casing. The lens serves to determine the diameter of the light beam and the optical axis of the same. The light source may be of the type which emits light of a specific color, or may be a white light source which emits white light, e.g., a halogen lamp, with a color filter disposed on the light emitting side of the light source. Thus, the light projector 91 can project a light beam of a desired color. Horizontal trunnion shafts 903, which are perpendicular to the optical axis of the light projector 91, are provided on the cylindrical casing at positions which diametrically oppose each other and which are axially central or rather close to the open lower end of the cylindrical casing. These trunnion shafts are rotatably supported by the front and rear side plates of the bracket 902 at positions substantially midst between the left and right side plates of the same. Consequently, the light projector 91 is supported by a gimbal structure which is constituted by the frame 902 and the trunnion shafts 903 arranged to permit the projector 91 to swing in two orthogonal planes, whereby the optical axis of the light projector 91 can scribe a circle.

The arrangement is such that the direction of projection of the light by the light projector 91 is changed as a result of a tilting motion of a swivel rod 911 provided on the closed upper end of the light projector 91.

The aforesaid swivel motor 92 is mounted on the slant top plate 901 of the bracket 90. A rotary shaft 921 extends through an aperture 901*a* formed in the slant top plate 901. The swivel mechanism 93 further has a holder 931 attached to the lower end of the rotary shaft 921. An arm 932 having a predetermined length is secured to the holder 931 so as to extend in the direction perpendicular to the rotary shaft 921. A flexible connecting member 933 has a fitting portion fitting on the end of the arm 932 and a ring portion connected to the fitting portion. Thus, the flexible connecting member is connected to the end of the arm 932. The flexible connecting member 932 therefore rotates about the axis of the rotary shaft 921 in accordance with the rotation of the rotary shaft 921. The ring portion of the connecting member 933 receives the aforementioned swivel rod 911 of the light projector 91, so that the swivel rod 911 rotates together with the connecting member 933. The joint between the ring portion of the connecting member 933 and the swivel rod 911 o the light projector 91 may be accomplished in a manner like a universal joint. Thus, the swivel mechanism has the rotary shaft 921 which is arranged perpendicularly to the slant top plate 901 of the bracket 90 and which forms a predetermined angle with respect to the optical axis of the light projector 91, so that the spotlight SL moves along an arcuate path accurately following the curvature of the annular white flat surface 20.

A radially extending tab 940 is secured to an upper portion of the rotary shaft 921. Three photo-interrupters 941, 942 and 943 are arranged at an equal distance from the axis of the rotary shaft 921, along the path of rotation of the tan 940. Each photo-interrupter has two portions which oppose each other across the path of rotation of the tab 940. A rear photo-interrupter 941 corresponds to the posture of the light projector 91 at which the spotlight SL impinges upon a 90° behind position on the annular white flat surface 20, while a front photo-interrupter 943 corresponds to the posture of the light projector 91 at which the spotlight SL impinges upon a 90° advanced position on the white flat surface 20. The central photo-interrupter 942 corresponds to the posture of the light projector 91 at which the spotlight impinges upon a position which is almost midway of the arcuate path of the light spot LSP. Means are provided for detecting the swivelling of the light projector 91 beyond the marginal 90° positions behind and ahead of the central position, so as to effectively prevent breakdown of the mechanism which may otherwise occur due to excessive stroking of the light projector 91 when the front and rear photo-interrupters erroneously fail to detect the tab. Although the left light projecting unit 9 alone has been described, it is to be understood that another light projecting unit 9, having the same construction, is provided also under the right side of the crown 7.

A description will now be given of the pattern of projection of light beams, with specific reference to FIGS. 10A to 10C. In this Figure, a circle marked by "R" indicates the position of the light spot formed by the spotlight SL from the right light projector 91, while a circle marked by "L" indicates the light spot formed by the spotlight SL from the left light projector 91. Thus, semi-circular arrows represent the annular white flat surface 20 of the base portion 2 along which the light spots oscillate.

Figure 10A:
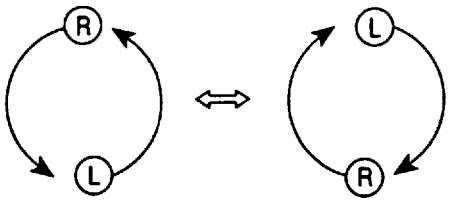
FIGS. 10A, 10B and 10C are illustrations of different patterns of projection of light beams.
Figure 10B:
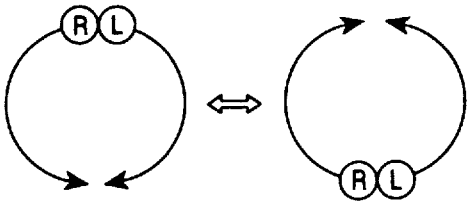
Figure 10C:
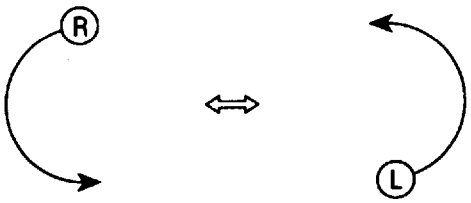

FIG. 10A shows a pattern in which the spotlights SL from the left and right light projectors 91 move synchronously in the same direction with a 180° positional or phase difference and then move back in the same counter direction with 180° difference. This operation is performed repeatedly. In FIG. 10B, cycles are repeated in which the light spots of the spotlights SL of the left and right light projectors 91 are initially set at the same position and move in opposite directions through 180°, respectively, and then move back to the starting position. In FIG. 10C, the light spot formed by the spotlight SL of the right light projector 91 is made to move through 180° while the left light projector is kept off. Then, the right light projector 91 is turned off and the left light projector 91 is turned on, so that the light spot of the spotlight SL from the left light projector 91 alone moves through 180° in the same direction. Thus, the left light projector 91 is returned without forming light spot to the starting position while the spot light of the right light projector moves along its path and, similarly, the right light projector 91 is returned without forming light spot to the starting position while the light spot formed by the left light projector travels along its arcuate path. This operation is cyclically repeated.

Figure 11A:
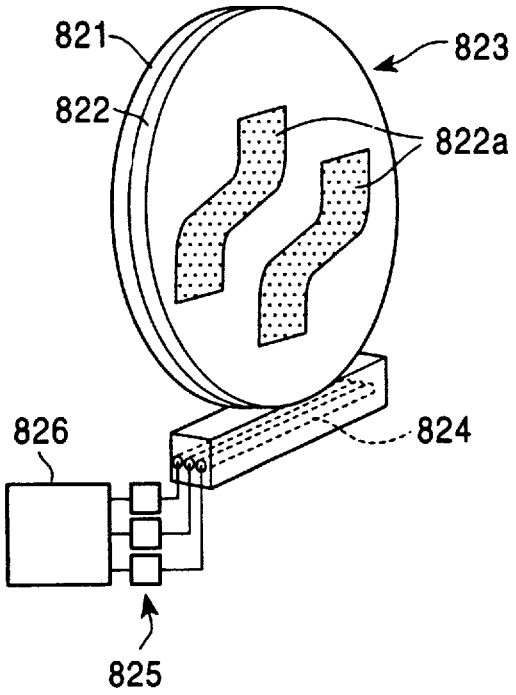
FIG. 11A is a perspective view of an illuminating structure of an illuminating portion of a support.

A description will now be given of the construction of the illuminating unit 82 on the support portion 8, with reference to FIGS. 11A, 11B and 11C. FIG. 11A is a perspective view of the illuminating unit 82, FIG. 11B is a sectional view of a luminescent plate and FIG. 11C is a plan view of a different construction of the illuminating unit.

Figure 11B:
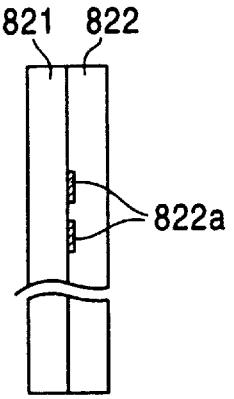
FIG. 11B is a sectional view of a luminescent plate.
Figure 11C:
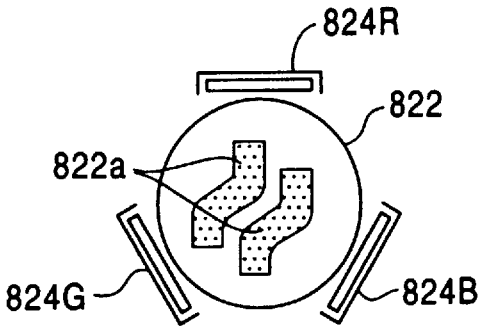
FIG. 11C is an illustration of a modification of the illuminating portion.

Referring first to FIGS. 11A and 11B, the illuminating unit 82 has a peripheral annular cover 820, a luminescent plate 823 composed of a pair of transparent plates 821, 822, a light source unit 824 which is disposed at a suitable position along the luminescent plate 823, a driver 825 and a light source control unit 826. The transparent plate 821 of the luminescent plate 823 is made of a glass sheet or a sheet of an acrylic resin, while the transparent plate 822 is made of a resin which may be an acrylic resin. The inner surface of the transparent plate 822 facing the plate 821 is engraved in a predetermined configuration as at 822*a* so as to provide a light diffusion surface. In the illustrated embodiment, the luminescent plate 823 has a diameter on the order of several tens of centimeters and a thickness of 10 mm or so. A reflective film, presented by a reflective tape or a reflective material, is formed on the peripheral surface of the luminescent plate 823 except a light guide portion which faces the light source unit 824. Light introduced into the luminescent plate 823 from the light source unit 824 through the light guide portion is reflected by the peripheral reflective film and is scattered so that the luminescent plate 823 illuminates at a predetermined level of luminance.

The light source unit 824 includes three fluorescent lamps 824R, 824G and 824B of red (R), green (G) and blue (B) colors which are arranged in parallel with one another within a box-like casing which faces and opens towards the peripheral surface of the luminescent plate 823. The fluorescent lamps 824R, 824G and 824B may be of the type which emits the light of the respective colors or all these may be white luminescent lamps which are coated by the filters of R, G and B colors so that light of each color is obtained through each filter.

A driver 825 has color drivers 825R, 825G and 825B which correspond to the respective fluorescent lamps so as to supply electrical power to the corresponding fluorescent lamps so that the lamps can illuminate independently of one another. The light source control unit 826 supplies illuminating signals to each, two or all of the three color drivers 825R, 825G and 825B so that the fluorescent lamps 824R, 824G and 824B illuminate independently or in a suitable combination to provide a monochromatic or composite color light, thus contributing to further enhancement of the stage effect on the play.

The pattern of supply of the illuminating signals may be suitably determined so as to provide different stage effects according to the state of the game machine or the phase of the play. For example, different patterns of supply of the illuminating signals are used when the game machine is in a demonstrating mode to tempt the peoples, when the game is started and when a ball B has been detected by the reading portion 5, and when the player has won as a high score is obtained by satisfaction of a predetermined condition which is expressed in terms of combinations of the magnetic codes read from the balls B extracted by the reading portion 5.

The light from the light source unit 824 propagates through the luminescent plate 823 and is reflected in a random manner by the diffusion surface presented by the engraved portion 822*a*, so as to be diffused in all radial directions. Consequently, the engraved portion 822*a* is recognized as if it emits light by itself. In this embodiment, it is possible to produce light of any desired color, thanks to the use of the lights of three primary colors, thus enhancing the stage effect on the play. The luminance of each fluorescent lamp 824R, 824G and 824B can be controlled through a direct luminance control or by controlling the duty ratio of illumination, whereby illuminating light of any composite color can be obtained.

FIG. 11C shows an alternative arrangement in which the fluorescent lamps 824R, 824G and 824B are arranged at equi-spaced three positions around the luminescent plate 823. Such an equi-spacing of the light sources of different colors ensures more uniform distribution of light throughout the engraved portion 822*a*. In this case, the peripheral surface of the luminescent plate 823 is devoid of the reflective film at the portions confronted by the respective fluorescent lamps 824R, 824G and 824B.

Figure 12A:
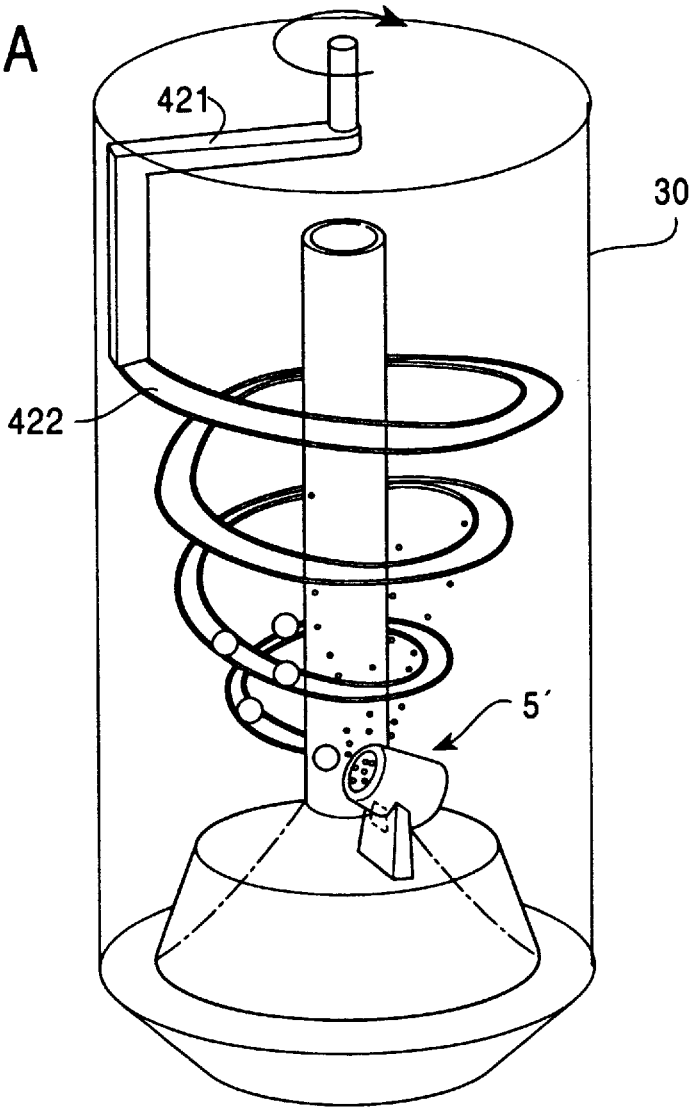
FIG. 12A is a schematic perspective view of a modification of an information reading portion.
Figure 12B:
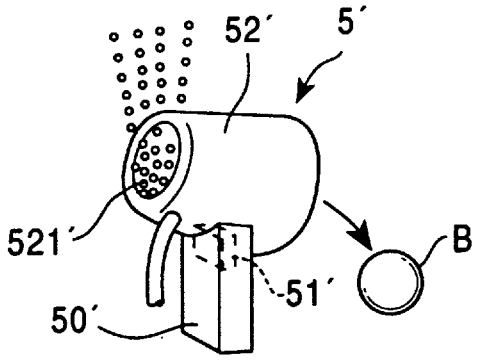
FIG. 12B is an enlarged perspective view of the reading portion shown in FIG. 12A.

FIG. 12A is a schematic perspective view of a modification of the reading portion 5, while FIG. 12B is an enlarged perspective view of the same. The reading portion, denoted by 5', has a supporting portion 50', a sensor element 51' embedded in the supporting portion 50', and a tubular portion 52' supported by the supporting portion 50' and having a bore of a diameter slightly greater than that of the ball B, the tubular portion 52' being slightly inclined. The tubular portion 52' has a ball inlet 521' which is disposed to face the rotation path of the lower end of the guide rail 422, so that a ball B released from the lower end of the guide rail 422 is thrown into the ball inlet 521' provided that at this instance the lower end of the guide rail 422 faces the ball inlet 521'. The magnetic codes of the ball B are read by the sensor element 51' while the ball B passes through the tubular portion 52', whereby the ball B is "extracted". In this modification, when a ball B is received in the tubular portion 52', bubbles of air are generated from a lower portion of the ball inlet 521' so as to prevent any succeeding ball B, which has rolled down along the guide rail 422 immediately after the received ball B, from entering the tubular portion 52'. In order to enable generation of air bubbles, a conduit is led to the lower portion of the tubular portion 52' defining the ball inlet 521' from the compressor via a hose or the like, and forming tiny holes in the lower portion of the ball inlet 521', so that compressed air is relieved from the tiny holes to form bubbles as illustrated n FIG. 12B. The air bubbles serves as a barrier which prevent any subsequent ball B from coming into the tubular portion 52' immediately after the entry of the preceding ball B. The supply of the air for generating the air bubbles is continued, at the shortest, to a moment immediately before completion of one full rotation of the guide rail 422 after the receipt of the ball B in the tubular portion 52'. Continuation of bubble generation also serves to minimize the risk that any ball B other than those rolling down along the guide rail 422 is accidentally received in the reading portion 5'.

Figure 19:
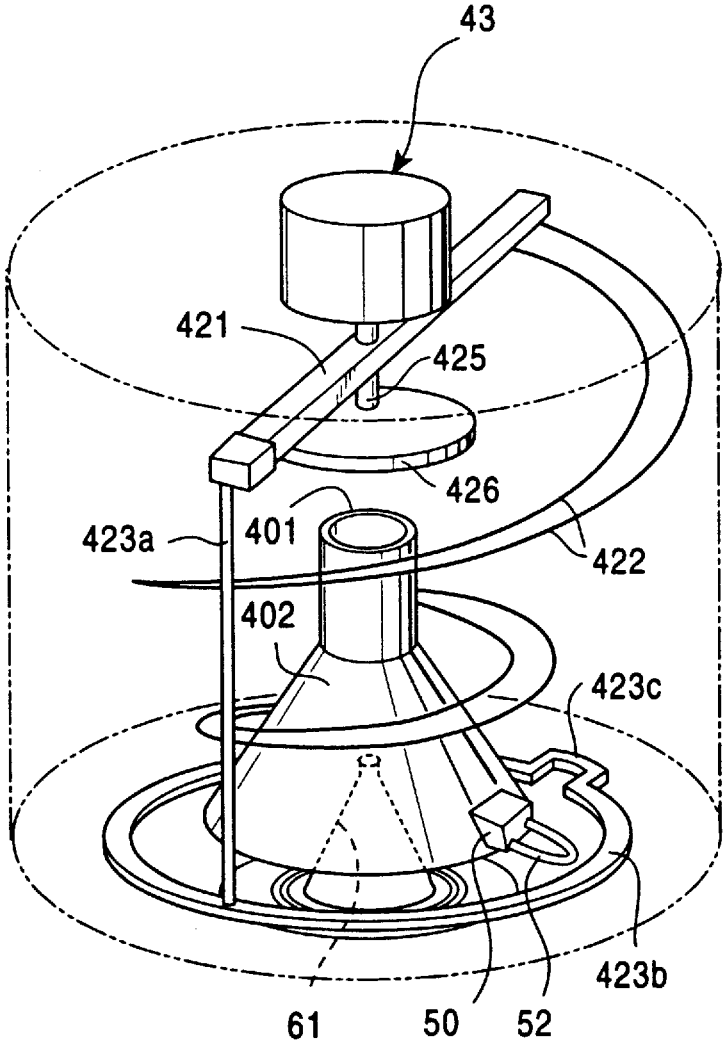
FIG. 19 is a schematic perspective view of a portion of another example of the mechanical section.

FIG. 19 shows a modification of the embodiment described hereinbefore. This modification has a gate plate 423 having a construction different from that of the embodiment described before. In addition, an anti-jump member is provided for preventing the balls form jumping above the water level in the tank.

The gate member 423 which depends from the rotary arm 421 has, as in the embodiment described before, a vertical arm 423*a* and a horizontal annular gate plate 423*b* secured to the vertical arm 423*a*. The lower end of the vertical arm

423*a* is set at a level which is lower by a half diameter of the ball B than the level of the ring 52. As will be seen from FIG. 19, the gate plate 423*b* has a radially expanding portion 423*c* which has a predetermined circumferential length and which deviates radially outward from the position right below the ring 52 by a distance equal to or slightly greater than the diameter of the ring 52. Thus, the gate plate 423*b* prevents the ball B received in the ring 52 from sinking, so that the ball B is temporarily held in the ring for a certain period during which the magnetic codes of the ball B are read. As a result of rotation of the gate plate 423*b*, the radially expanding port ion 423*c* of the gate plate 423*b* is brought to a position right below the ring 52 to allow the ball B to fall. The circumferential length of the radially expanding portion 423*c* is determined to be large enough to permit the ball to pass through the cutout portion which is being rotated.

Figure 20:
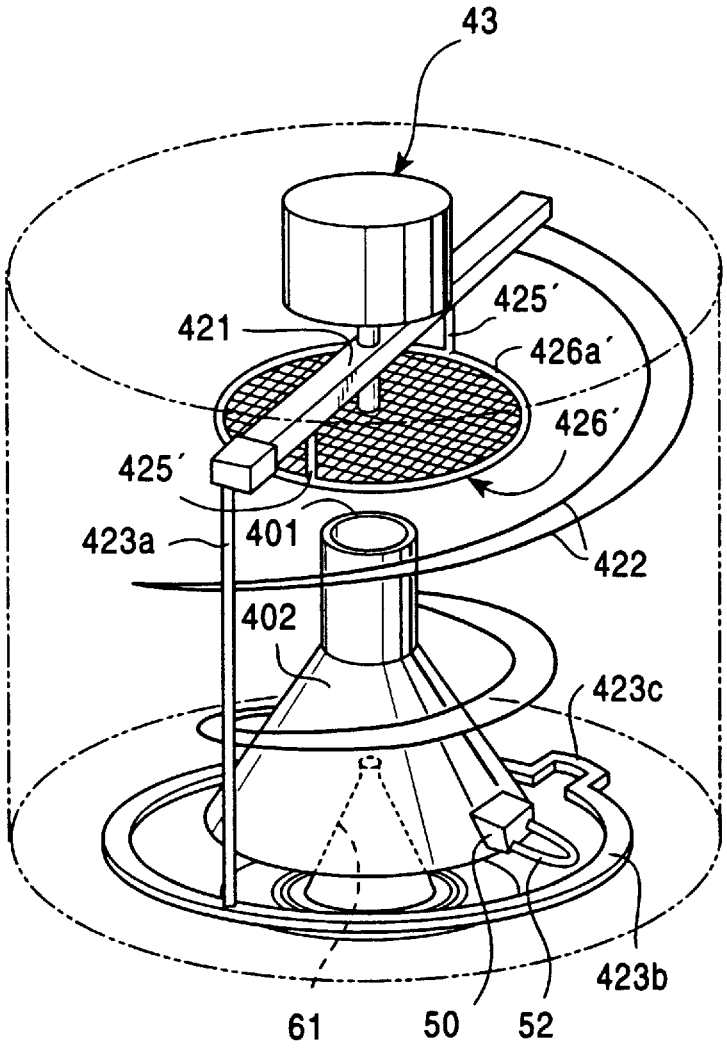
FIG. 20 is a schematic illustration of another example of an anti-jump member used in the structure shown in FIG. 19.

As will be seen from FIG. 19, the rotary arm has a coaxial shaft 425 extending downward therefrom. An anti-jump member 426 is secured to the lower end of this shaft 425. The shaft 425 has such a length that its lower end is substantially flush with the water surface in the tank. The anti-jump member 426 is a disk-shaped member made of a rigid or flexible material, and is disposed so as to oppose the upper end of the tubular passage 401. The anti-jump member 426 effectively prevents balls pushed upward by the upward flow of water through the passage tube 401 from jumping above the water surface, thus eliminating collision of the balls B with the cover 31 of the tank which otherwise may take place to generate collision noise or cause damaging of the cover and the balls. FIG. 20 shows another example of the anti-jump member 426' which is formed of a mesh or a net. This anti-jump member 426' is supported by a circumferential frame 426*a'* which in turn is supported by a plurality of arms 425' which plays the same role as the arm 425. In the illustrated embodiment, there are two such arms 425'. The anti-jump members 426, 426' need not always have disk-like shape, and can have any suitable shape such as ribs, provided that they can effectively stop the jumping of the balls B. The position of these anti-jump members 426, 426' also may be varied: namely, they may be placed slightly below the water surface, instead of being flush with the water surface. Alternatively, the anti-jump member may be a floating member such as a circular floating sheet which is arranged to cover at least the region right above the passage tube 401.

Figure 21:
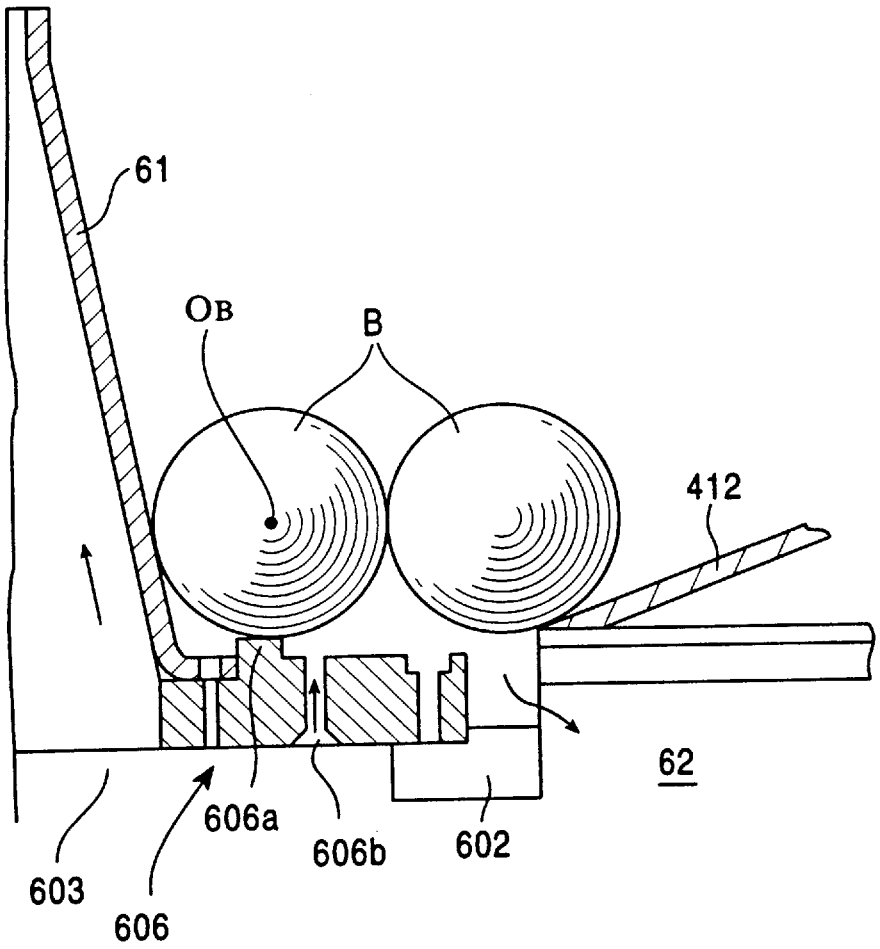
FIG. 21 is a sectional side elevational view of another example of the structure on the upper face of a discharge tube of the liquid supply portion.
Figure 22:
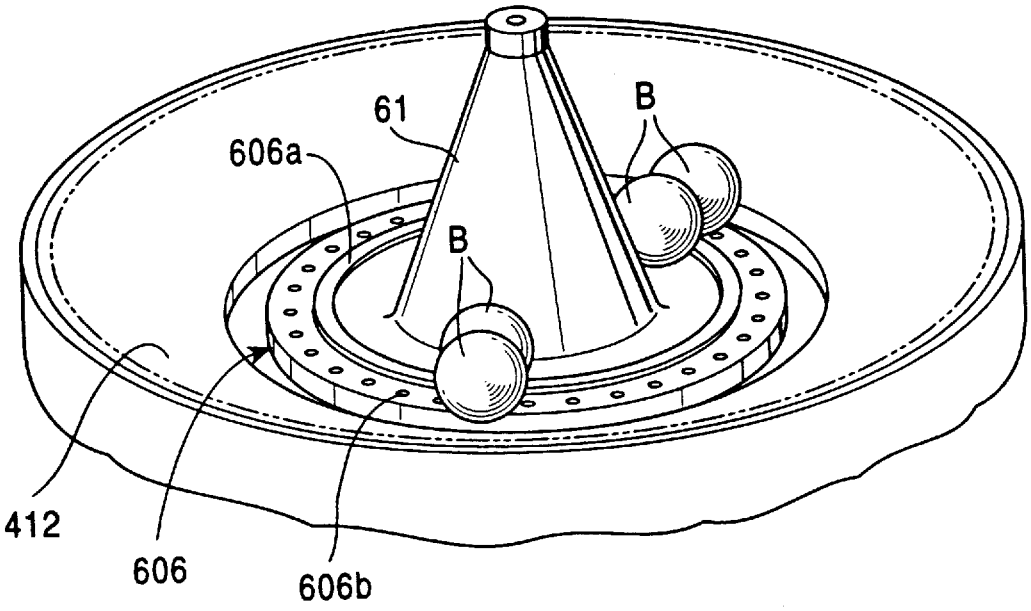
FIG. 22 is a perspective view of still another example of the structure on the upper face of a discharge tube of the liquid supply portion.

FIG. 21 is a sectional side view illustrating another example of the structure on the upper face of the discharge tube in the liquid supply portion, while FIG. 22 is a perspective view of the same. In this arrangement, the hole 603 formed in the ceiling 602 of the discharge tube 60 has a substantial diameter. The ceiling 602 and the base portion of the nozzle 601 are fixed to each other through an intermediate plate 606 having a predetermined thickness. The intermediate plate 606 has a central hole through which the liquid is supplied into the nozzle 61. An annular protrusion 606*a* is formed on the upper surface of the ring plate 606 concentrically with the central hole. A multiplicity of small holes 606*b*, opening both in the upper and lower surfaces of the ring plate 606, are formed along a circle surrounding the annular protrusion 606*a*. The central hole 603 of the discharge tube 60 has a diameter large enough to span the circle along which the small holes 606*b* are formed.

The annular protrusion 606*a* is formed at such a position that the center $O_B$ of a ball which is on the upper face of the intermediate plate 606 and contacting the wall of the nozzle 61 is positioned right above the annular protrusion 606*a*, i.e., such that the ball B rests on this annular protrusion 606*a*. With this arrangement, balls B are placed on the annular protrusion 606*a* regardless of the positions to which the balls have fallen. The small holes 606*b* are formed along the circle which is concentric with the annular protrusion 606*a* and having a diameter slightly greater than that of the annular protrusion 606*a*. Thus, the radial distance between the annular protrusion 606*a* and the circle along which the small holes 606*b* are formed is so determined that the upward flow of the liquid coming from the small holes collide with the lower face of a ball B resting on the annular protrusion 606*a* so as to effectively push the ball B upward. Preferably, the radial distance between the outer surface of the nozzle 61 and the lower end of the slant surface 412 is so determined as to be somewhat smaller than the distance which would accommodate a pair of balls B aligned in the same radial direction, as will be seen from FIG. 21. More preferably, the above-mentioned radial distance is so determined that the outer ball B contacts the inner ball B at a point on the latter which is at the same level or slightly below the level of the center $O_B$ of the inner ball. When the distance between the outer peripheral surface of the nozzle 61 and the lower end of the slant surface 412 is determined to be slightly smaller than the distance which would accommodate a pair of balls B aligned in the same radial direction as shown in FIG. 21, the radially outer ball B, immediately after the inner ball B has been lifted by the upward flow of the liquid, is allowed to fall from the lower end of the slant surface 412 onto the upper surface of the intermediate plate 606. It is thus possible to bring balls B into contact with the outer surface of the nozzle 61 as much as possible.

Figure 23:
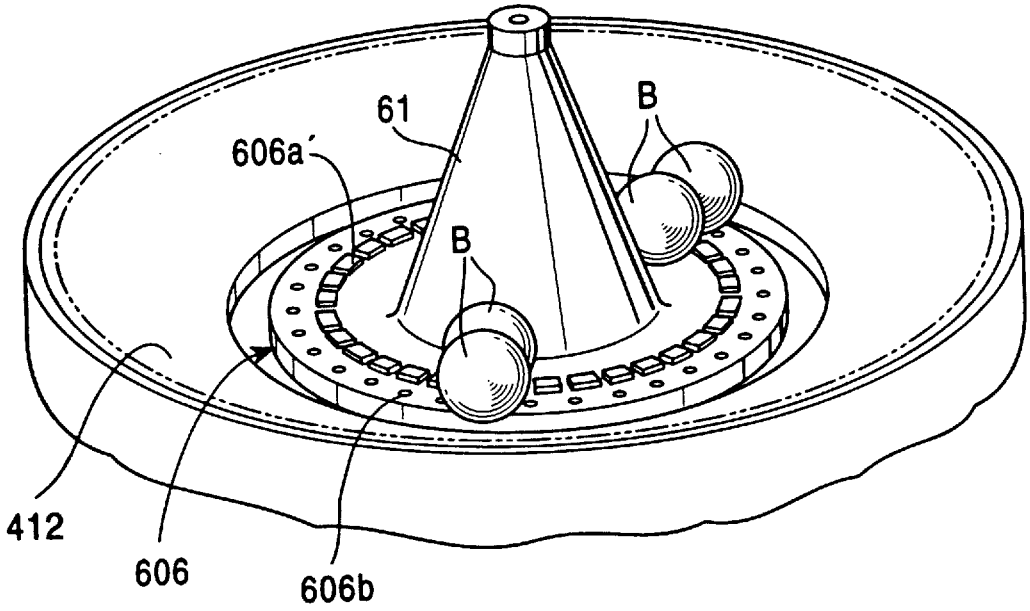
FIG. 23 is a perspective view of a further example of the structure on the upper face of a discharge tube of the liquid supply portion.

FIG. 23 is a perspective view of a different example of the structure on the upper surface of the discharge tube in the liquid supply portion. In this example, the annular ridge 606*a* of the structure described in connection with FIG. 22 is cut at a pitch equal to or smaller than the radius of the ball B into a plurality of segments of protrusion. With this arrangement, any ball falling down along the slant surface is placed on the segments 606*a'* of the annular protrusion.

Figure 24:
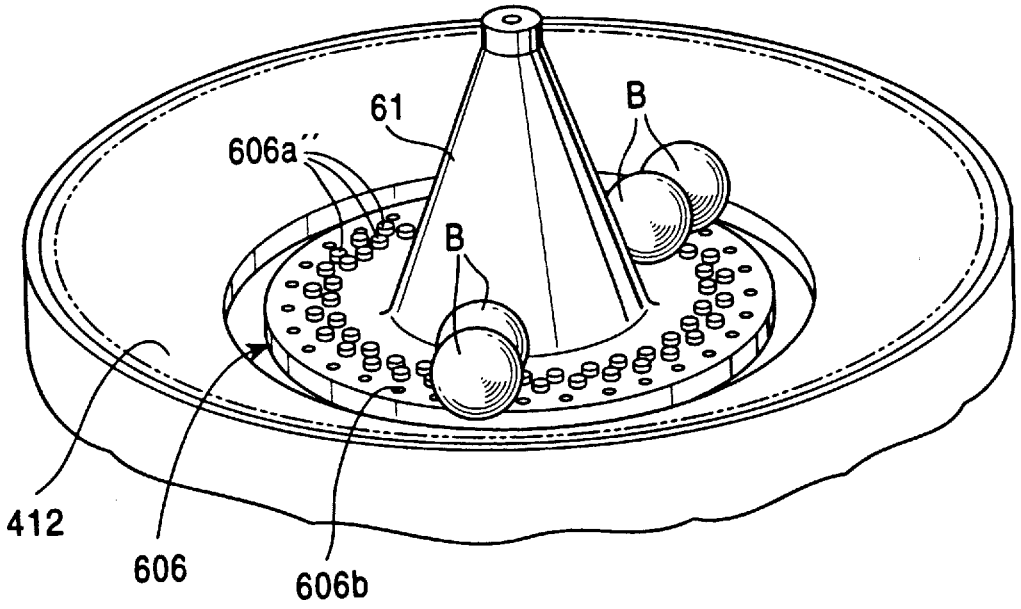
FIG. 24 is a perspective view of a yet further example of the structure on the upper face of a discharge tube of the liquid supply portion .

FIG. 24 shows a different example of the structure on the upper surface of the discharge tube in the liquid supply portion. In this embodiment, the annular protrusion is constituted by a plurality of small segments 606*a"* each having a size smaller than that of the segment 606*a'* shown in FIG. 23, the segments 606*a"* being arranged in a radially staggered manner along first and second concentric circles of different diameters, i.e., along the circle of the annular protrusion. According to this arrangement, not only the balls B contacting the nozzle 61 but also other balls B are placed on the annular row of projections 606*a"*, so as to be effectively pushed upward by the upward flow of the liquid from the small holes 606*b* mentioned before. The segment 606*a'* and the projections 606" need not always have flat surfaces, and can have various forms provided that they can hold the balls B at a level above the level of the upper surface of the intermediate plate 606. It is also possible to use a plurality of radial ribs arranged along a circle so as to form the annular protrusion.

Figure 13:
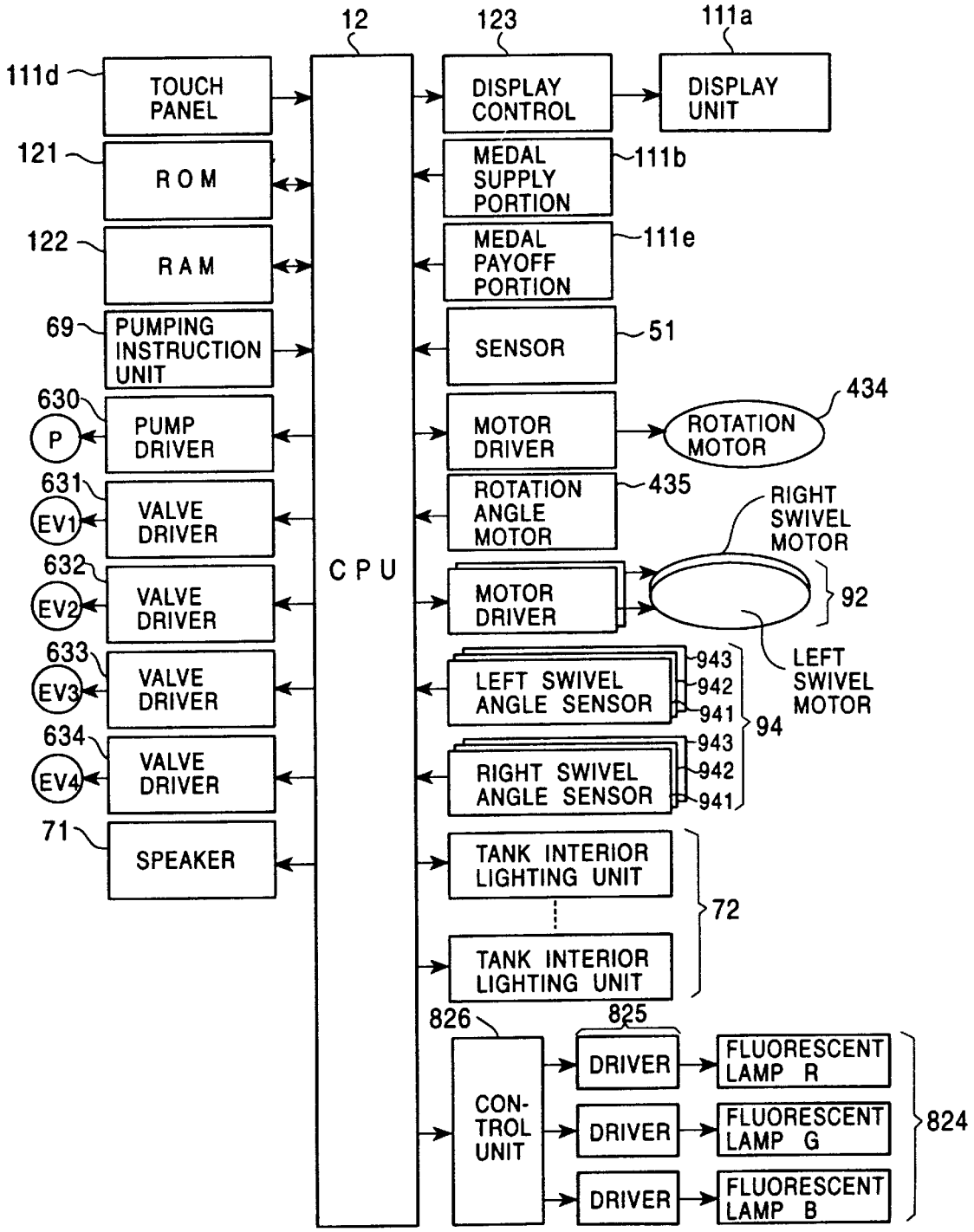
FIG. 13 is a diagram showing control blocks of the game machine embodying the present invention.

A description will now be given of control blocks of the game machine embodying the present invention, with reference to FIG. 13.

Referring to this Figure, a central processing unit (referred to as "CPU", hereinafter) 12 performs overall control of the whole game machine. The CPU 12 has a ROM 121 storing control programs and a RAM 122 which temporarily stores data under processing. Although the CPU conducts overall control of the whole machine, the arrangement may be such that a microcomputer commanding the mechanical part of the machine performs the control of the mechanical part 1 and the CPU 12 communicates with such a microcomputer to indirectly control the mechanical part 1. The medal supply portion 111*b* detects supply of medals, as well as the number of the medals supplied. The CPU determines, based on information given by the medal supply portion 111*b*, whether or not the number of the supplied metals has reached a predetermined number which is necessary for starting a game, and permits the game to start when the predetermined number has been reached. The medal payoff portion 111*e* pays off a predetermined number of medals corresponding to the score gained by the player. A credit play mode is available in which the number of the metals deposited to the player is monitored by the RAM 122 and pays off the balance at once when requested by the player. A pumping instruction unit 69 has a switch or the like which, when turned on for the purpose of maintenance, causes the CPU 12 to give a draining signal to the pump driving unit 630 and solenoid valve driving signals to the valve drivers 631 to 633, so that the pump P is started and the solenoid valves EV1 to EV4 are suitably controlled to allow the water W inside the tank to be drained to the sub-tank 64. After the maintenance work, the switch is operated to give tank filling instruction so that the water W is returned from the sub-tank 64 to the tank 30.

During the playing, various kinds of information are displayed on the display portion 111*a* of each terminal 111 in the input section 11, as will be described below with reference to FIGS. 14 to 18.

Figure 14:
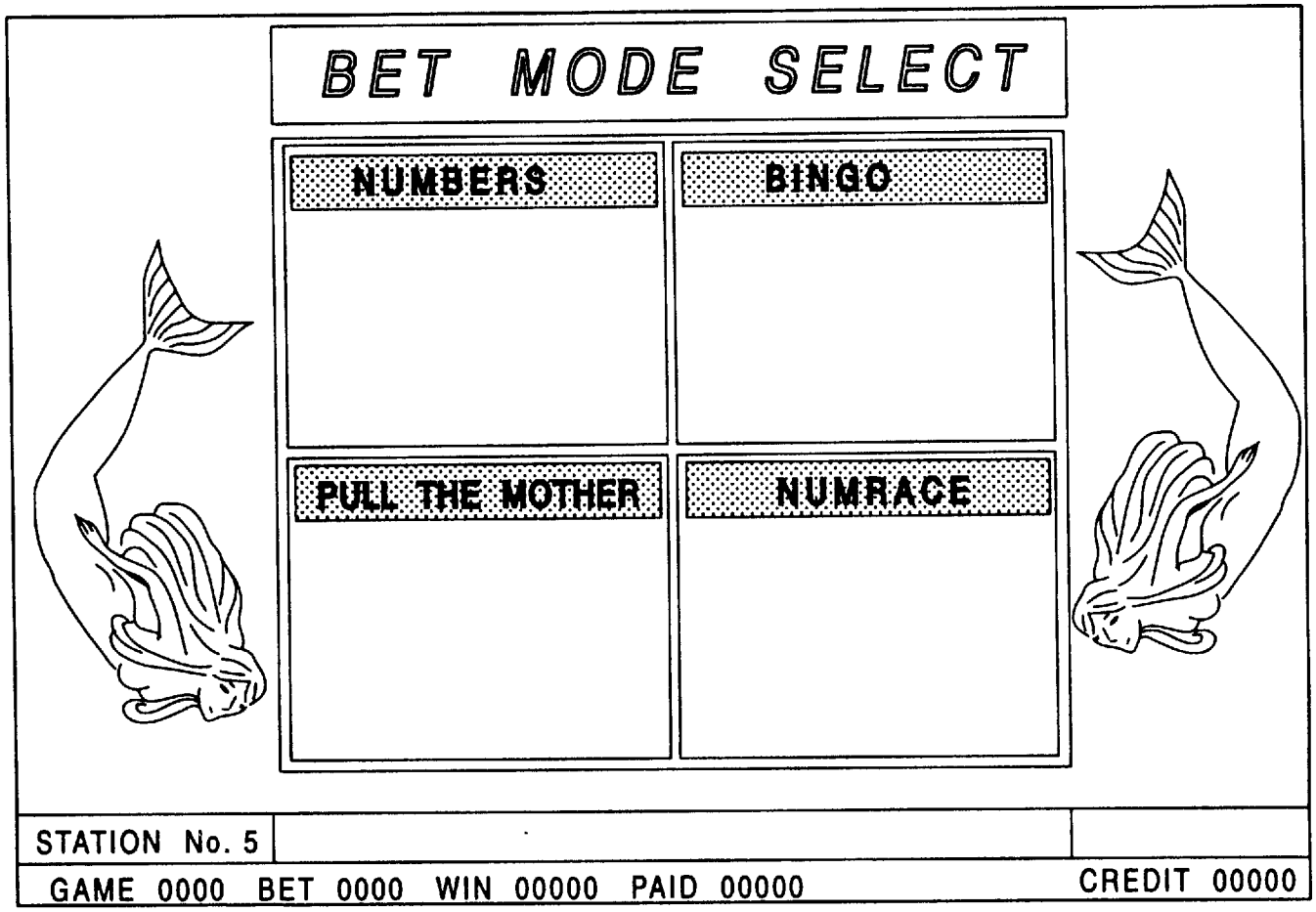
FIG. 14 is an illustration of an initial screen of a display of the game machine.

FIG. 14 illustrates an initial screen which shows types of games available in this game machine. In the illustrated embodiment, there are four types of games: namely, NUMBERS GAME, BINGO GAME, PULL THE MOTHER GAME and NUMRACE GAME. The player can select one of these games by touching, with a finger, a frame showing the name of the game of interest. The coordinate position of the touch is read by the touch panel 111*d*, and the game program is read from the table of the selected game which has been stored in the ROM 121 in relation to the coordinate position. Then, the content of the display is changed to that of the selected game. The frames such as STATION. No., GAME, BET, WIN, PAID and CREDIT are common to all types of the games available on the machine. The frame GAME shows the total number of the plays of the game, BET shows the number of the medals bet, WIN shows odds, PAID shows the number of the medals paid off, and CREDIT shows the number of the medals deposited.

The game proceeds in accordance with the operation of the game machine having the construction as described with reference to FIGS. 1 to 12 under the control of the blocks described in connection with FIG. 13. In each game, five balls B are extracted from the 30 balls B, in accordance with the order in which the balls B are trapped in the reading portion, and magnetic codes of these balls B, indicative of the color and the numeral carried by each ball B, are read by the reading portion 5, whereby the numerals and colors are picked up. Each of the four games relies upon these colors and numerals.

Figure 15:
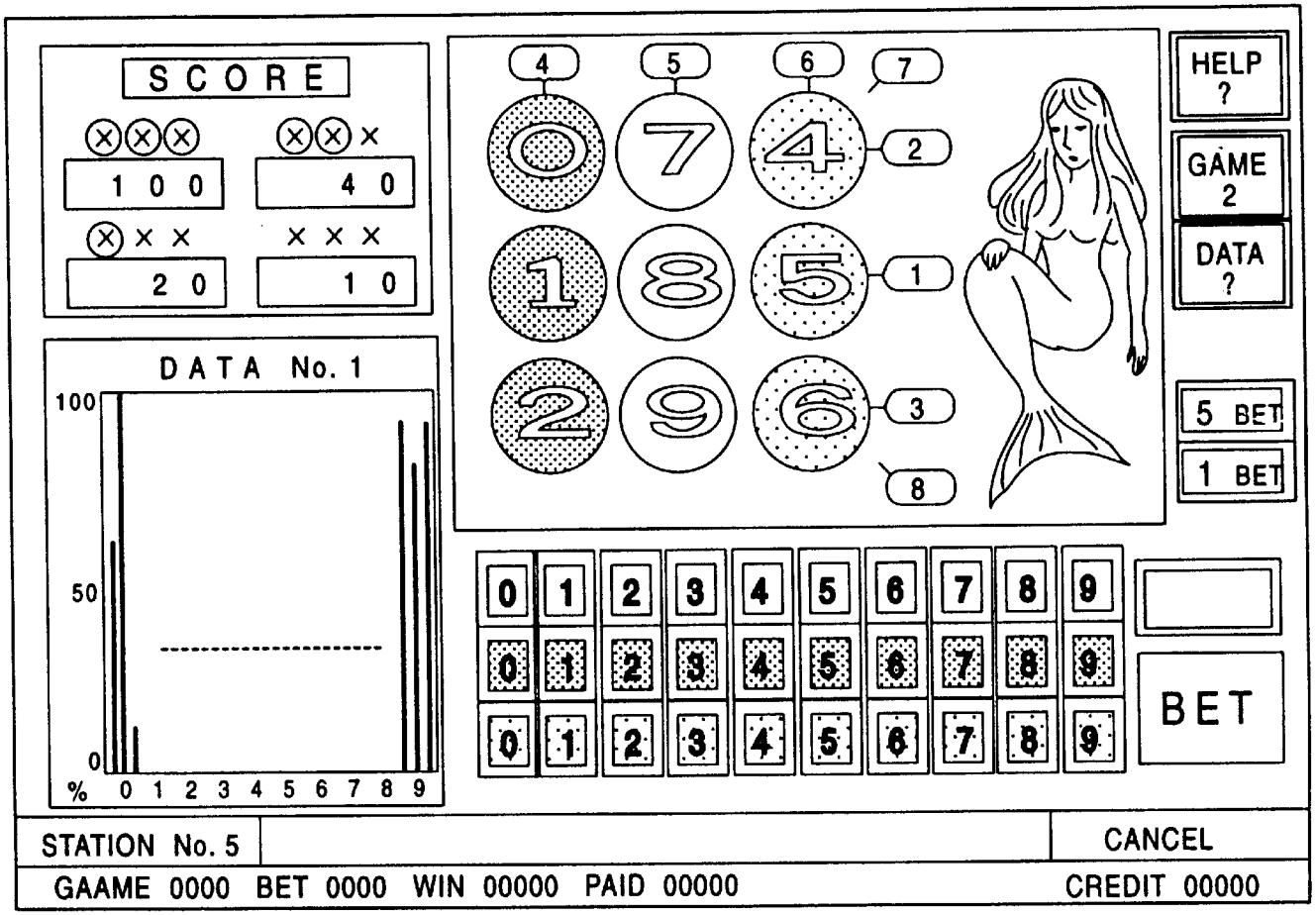
FIG. 15 is an illustration of the content displayed when a NUMBERS GAME mode has been selected.

The operation performed when the NUMBERS GAME has been selected will be described with reference to FIG. 15. There are three horizontal lines of numerals each containing numerals 0 to 9, at a right portion of the screen above the aforesaid common frames. The first non-halftone line corresponds to red color. The second line which is shown by thick halftone corresponds to blue color, while the third line shown by thin halftone corresponds to yellow color.

A matrix of circular boxes arranged in 3 lines and 3 columns is displayed immediately above the above-mentioned three lines of numerals. The player can arbitrarily set the colors and numerals in the circular boxes of the second line of the matrix. In this case, the player has set numeral 1 of red color (this will be expressed as "red #1"), numeral 8 of blue color (blue #8) and numeral 5 of yellow color (yellow #5), as illustrated. Then, the machine automatically sets colors and numerals in the circular boxes of the first line, such that the sequence of the colors is the same as that of the second line but the numerals of each circular box is smaller by one than that in the corresponding box of the second line of the matrix. At the same time, colors and numerals are set in the third line of the matrix such that the sequence of the colors is the same as that of the second line but the numerals of each circular box is greater by one than that in the corresponding box of the second line of the matrix. When a numeral in the matrix coincides with the numeral carried by an extracted ball B, the display of the numeral is highlighted, flickered or otherwise emphasized to indicate the fact of the incidence. Numerals "4", "5" and "6" are shown at right above the first line of the matrix at positions corresponding to the three columns. Similarly, numerals "7", "2", "1", "3" and "8" are displayed on the right side of the third column of the matrix at positions corresponding to the three lines, although numerals "7" and "8", which represent diagonal oblique lines, are respectively shown above and below the first and third lines of the matrix. These numerals "1" to "8" correspond to eight types of combinations of colors and numerals, including three presented by the three lines, three presented by the three columns, and two presented by two diagonal lines of the matrix. When the extracted five balls B contain any three balls B the numerals of which make a numeral series coinciding with one of the eight numeral series stated above, such a coincidence is judged as being a "hit".

An area on the left upper corner of the screen shows the score which is given to the hit, depending on the degree of coincidence of the colors between the balls and the "hit" numeral series. When there is no coincidence of color in the "hit" numeral series, the odds are only 10, so that the player gets medals of the number which is 10 times that of the bet. When coincidence is obtained on one numeral in the "hit" numeral series, 20 is given as the odds. When coincidence has been attained on two numerals out of the three, odds are 40 and, when coincidence of color has been obtained on all the three numerals of the numeral series, the player is paid a number which is 100 times that of the bet.

An area preserved in the left lower corner of the screen shows, in the form of bar graphs, the statistic data concerning the colors of balls of each numeral of the balls extracted in the preceding plays. Thus, in the illustrated case, the blue #0 ball was extracted in each of the plays.

In this game, the arrangement may be such that the numerals on the first line and the third line of the matrix appear progressively so that the number of the numeral lines to be hit is increased in accordance with the increase in the bet, i.e., the number of the medals bet. For instance, numerals appear at a time to fill in one or two circular boxes both the first and third lines of the matrix, in response to a predetermined increment of the bet. In FIG. 15, all the nine circular boxes have been filled by numerals. Areas 1 BET and 5 BET appearing on the right end of the screen indicates the number of the medals bet. For instance, a single touch on the 5 BET indicates that the player has bet 5 medals.

Figure 16:
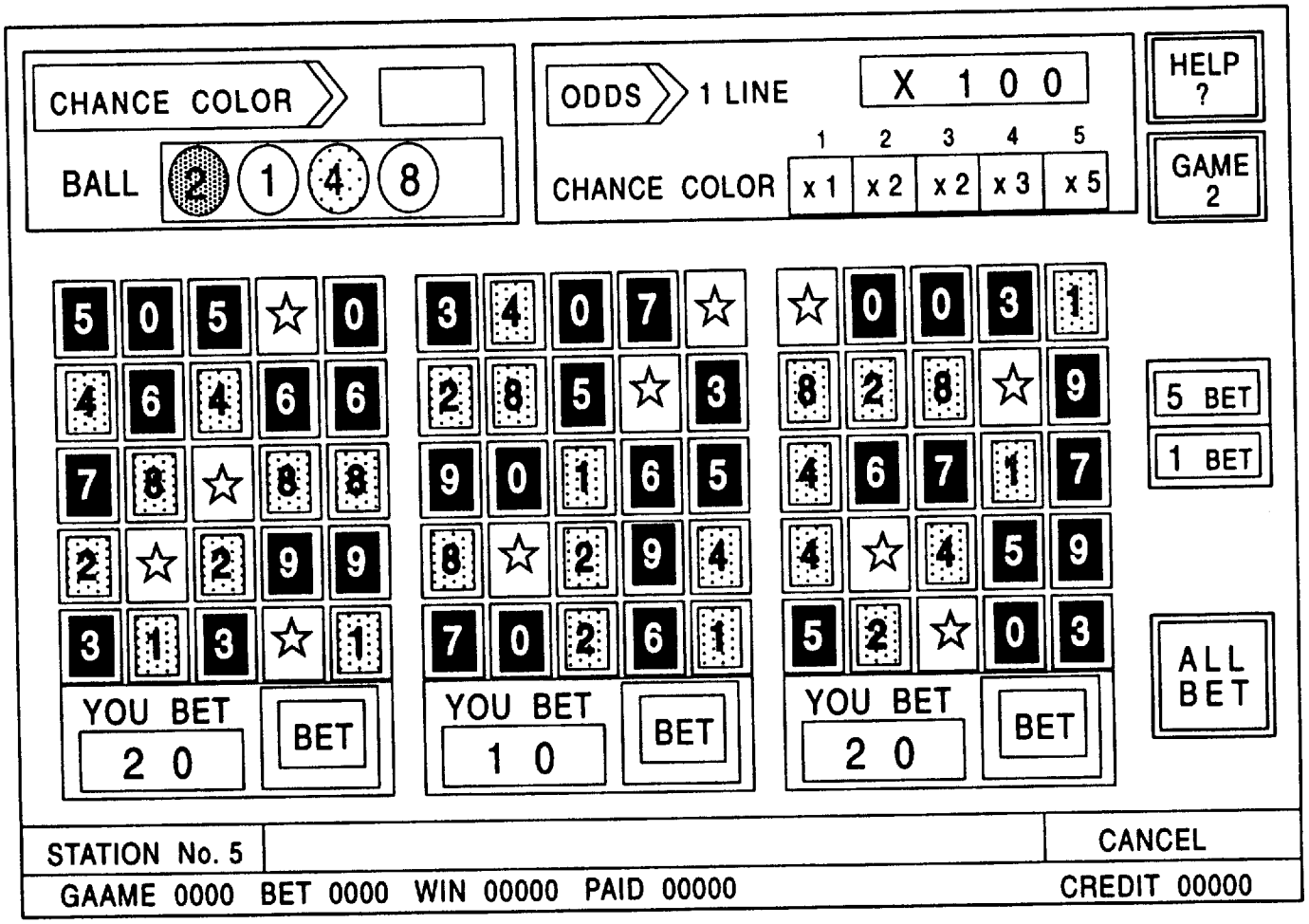
FIG. 16 is an illustration of the content displayed when a BINGO GAME mode has been selected.

A description will now be given of the operation performed when the BINGO GAME has been selected. FIG. 16 illustrates the content displayed on the screen when this mode of game has been selected. Three bingo cards are displayed on the screen. The arrangement may be such that the player can arbitrarily select three bingo cards from among numerous bingo cards which have been formed and registered in the ROM 121. Alternatively, the player may form bingo cards in accordance with a predetermined rule. The rule may be such that the card should have four boxes to which star marks indicative of any color and numeral are attached, while colors and numerals are arrange in a random manner. For instance, colors are suitably allocated to predetermined numbers of boxes among the remainder 21 boxes, with each numeral appearing in boxes of a number which is at least one but does not exceeds a predetermined limit.

In FIG. 16, the numerals on each bingo card are shown in solid black boxes. Halftone boxes indicate that the numerals in these boxes coincide with those of extracted balls B. Actually, each of the boxes is painted with one of red, blue and yellow colors.

The player can bet medals by first touching the BET frame appearing below each bingo card, and then touching 1 BET or 5 BET appearing on the right end of the screen. The number of the medals thus bet are shown under the bingo cards. In the illustrated case, the numbers of bets are 20, 10 and 20 for the left, central and right bingo cards. After completing the bet on the three bingo cards, the player touches the menu ALL BET, so that the game is started. Coincidence of numeral series between the numerals of the extracted balls B and one of 12 lines of numerals set on the bingo card, including 5 horizontal lines, 5 vertical lines and 2 oblique lines, is a "hit".

In the illustrated case, four balls have already been extracted. These balls are blue #2 ball, red #1 ball, yellow #4 ball and the red #8 ball. Therefore, in each bingo card, the boxes carrying one of the numerals 1, 2, 4 and 8 are highlighted, flickered or otherwise emphasized to inform the player of the fact of coincidence. The odds are shown at a right upper position on the screen. In this case, odds of 100 are given for each of line which has completed a bingo. A lucky color, which is one of red, blue and yellow, is set for each ball B to be extracted next. The lucky color is shown at the left upper corner of the screen, as the CHANCE COLOR. Odds are multiplied with factors which are determined in accordance with the number of the extracted balls of the chance color. Such multiplication factors are shown immediately below the indication of the odds on the screen. For instance, when coincidence has been attained between the extracted five balls and one or more of the 12 lines set on each bingo card not only in the numerals but also in colors, the odds which has been set to 100 is multiplied with 5, i.e., the odds are increased. In the game machine of the present invention, there is a possibility that an identical ball is extracted repeatedly because the ball after reading of magnetic codes is circulated again. In this game machine, therefore, the control may be executed such that, when an identical ball, i.e., the ball of the same color and numeral, has been extracted again, the coincidence which has been attained by the previous extraction of the same ball is canceled, so that the fun of the game is further enhanced. In the illustrated embodiment, numerals 1, 2, 4 and 8 have been extracted, so that the third line "7, 8, 8, 8" of the left bingo card is in a condition ready for completing bingo. In regard to the central bingo card, the second column "4, 8, 0, 0", the fourth line "8, 2, 9, 4" and the diagonal line "1, 7" from right upper corner to left lower corner of the bingo card are waiting for bingo. In the right bingo card, the first column "8, 4, 4, 6" is in a condition ready for bingo.

Figure 17:
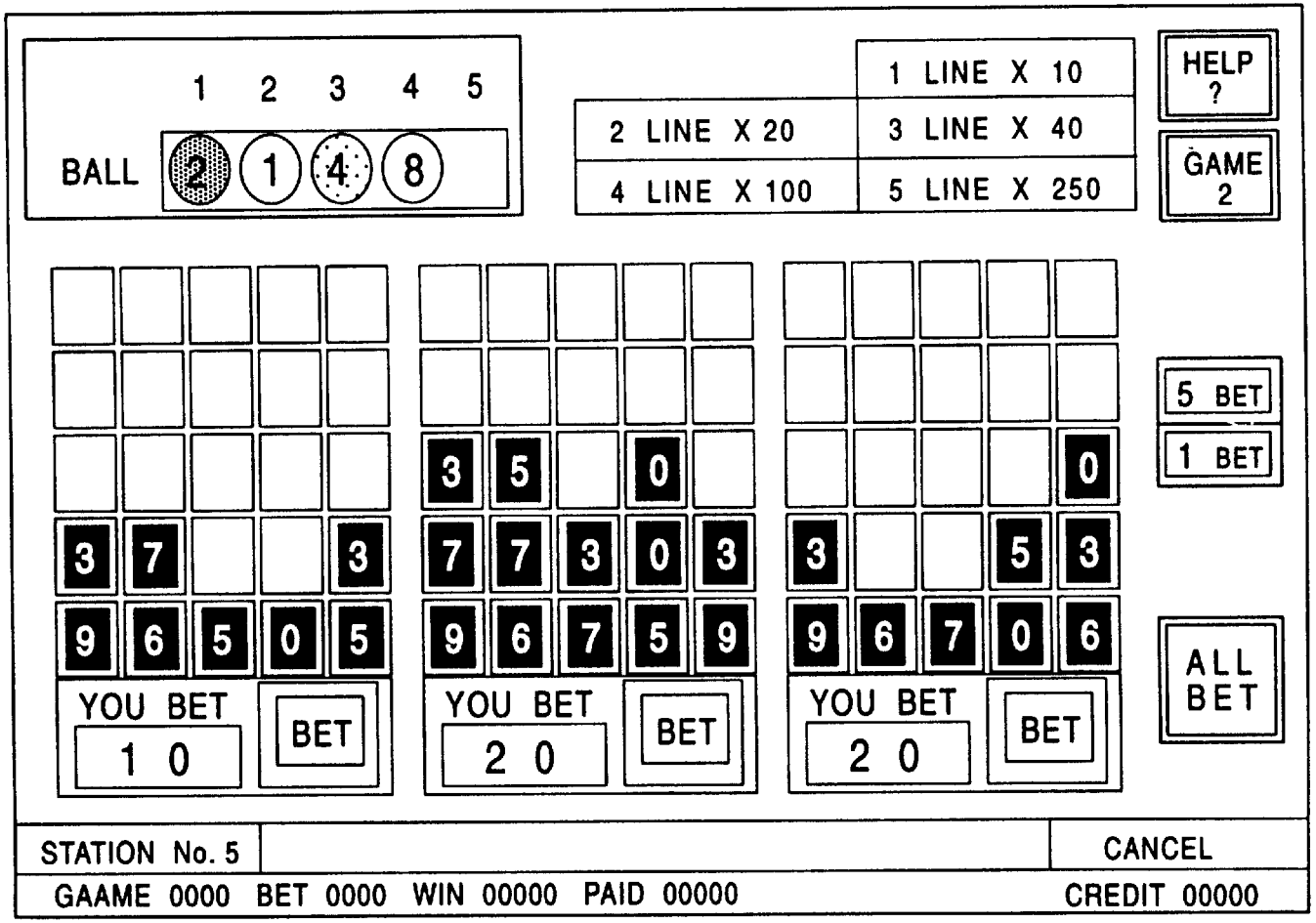
FIG. 17 is an illustration of the content displayed when a PULL THE MOTHER GAME mode has been selected.

A description will now be given of the operation performed when the PULL THE MOTOR GAME has been selected, with reference to FIG. 17 which shows the content displayed on the screen in this mode of game. Three cards each having 25 boxes are shown on the screen. At the beginning, all the boxes are filled with numerals in a random manner with the colors also allocated to these boxes in a random manner. The cards may be prepared in the same way as that in the BINGO GAME. The cards, however, do not have any star mark which is used in the bingo cards. As a ball B is extracted, the boxes having the numeral of the extracted ball B are changed into white blanks, and the numeral which has been placed on each box which has just been changed into white blank drops into this white blank. When the boxes on the left and right sides of the box into which the numeral has been dropped have the same numeral as the dropped numeral, these two blocks having such a numeral are also changed into white blanks. The user "wins" on each card when all the boxes in at least one column (vertical line) have been changed into the white blanks. Odds are set in accordance with the number of the wins, i.e., the number of the columns in which all the five boxes have been changed into white blanks. In the illustrated embodiment, odds are set to be 10 for one win (one column or vertical line), 20 for two wins, 40 for three wins, 100 for four wins, and 250 for five wins, i.e., when boxes have been changed into white blanks in all five columns (vertical lines). In FIG. 17, numerals 2, 1, 4 and 8 have been deleted from the boxes of all the three cards, because balls of the numerals 2, 1, 4 and 8 have already been extracted.

Figure 18:
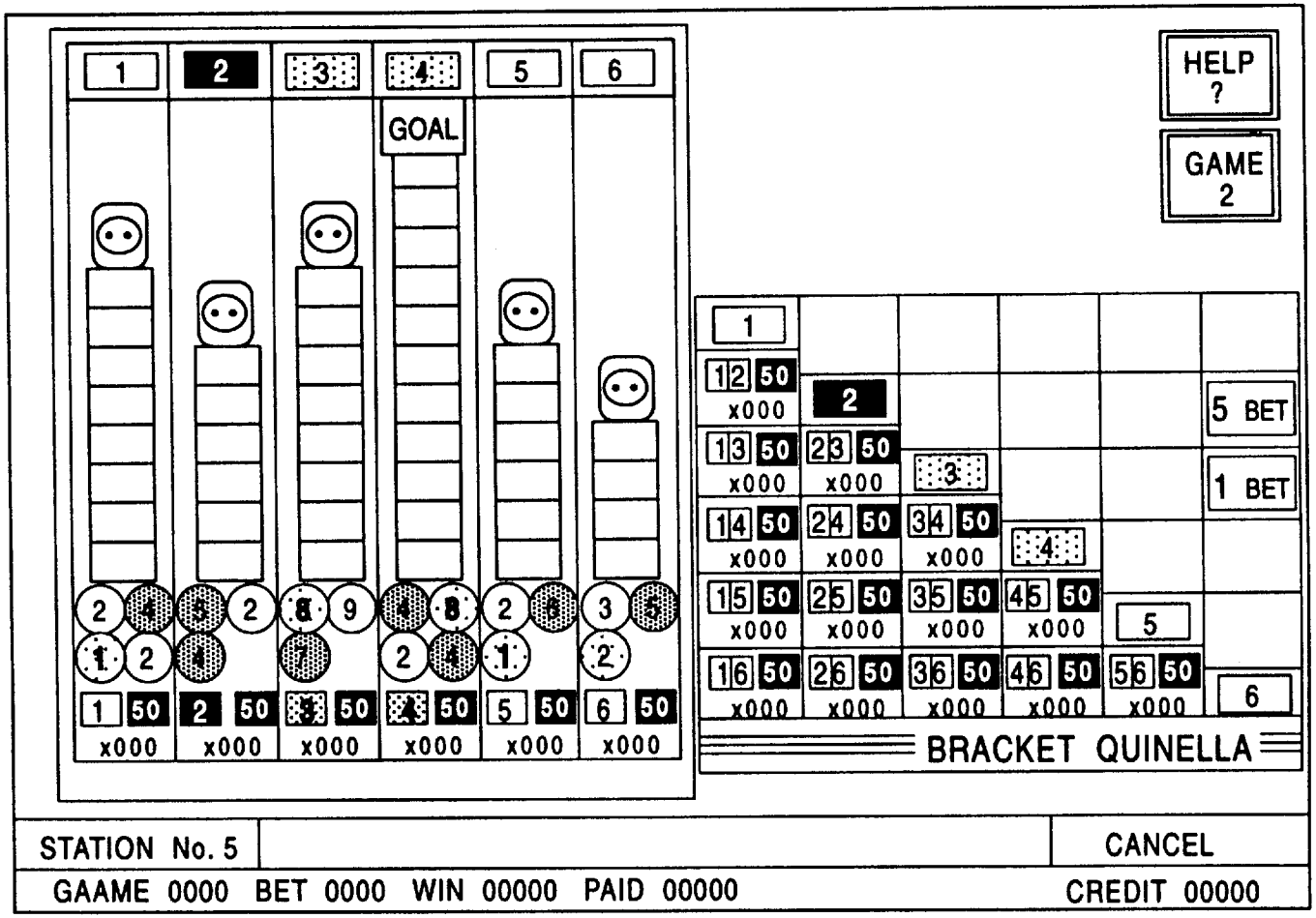
FIG. 18 is an illustration of the content displayed when a NUMRACE GAME mode has been selected.

A description will now be given of the operation performed when the NUMRACE GAME has been selected with reference to FIG. 18 which shows the content displayed on the screen when this mode is selected. There are six columns displayed on a left portion of the screen. Odds in accordance with win system (a system in which only the winner of the first place is forecast) are shown below the respective columns. Imaginary balls each having its own color and numeral are set for each of the six columns and are shown by illustration immediately above the indication of the odds. The number of the imaginary balls set for each column may be freely selected between 1 and 4. In the illustrated case, each column has three or four imaginary balls set therein. Basically, as a matter of common sense, smaller odds are set for columns having smaller number of balls. The number of the balls, as well as the colors and numerals of the ball, may be set in a random manner for each column. The right half part of the screen displays an odds table in accordance with place-show system (a system in which winners of the first and second places are forecast). The player can select either one or both of the "win" system and the "place-show" system, and bets on the selected system or systems by touching the menus of 1 BET or 5 BET.

In this game, each time a ball B is extracted, the numeral and color of the ball are checked up with the colors and numerals of the balls set in each column. When either the numeral or the color is found among the balls set in the column, a stack of white boxes grows upward by an amount corresponding to one white box, whereas, when a ball of the same color and numeral as those of the extracted ball has been set in a column, the stack of the white boxes grows in that column by an amount corresponding to two white boxes. The six columns thus run a race. When the number of the white boxes of the stack reaches 12, the stack reaches a GOAL, thus winning the race. If all the columns have reached the goal at a time, medals are paid as if the player has bet equally on all columns in accordance with the win system. It is possible to set a plurality of balls of identical numeral and color in the column. Such a setting balls offers a greater chance of outrunning which may occur depending on the color and the numeral of the last extracted ball, thus maintaining the fun of the game to the last of the race.

In the described embodiment of the present invention, the circulation of the water is created by the flow of water forcibly generated by an upwardly converging nozzle. This, however, is not exclusive and the circulation of water may be effected by creating a downward forced flow of water by means of a nozzle disposed at an upper portion of the machine. In such a case, it is necessary that the balls have a specific gravity smaller than that of the ball B.

It is also to be noted that the balls need not have the same specific gravity. The specific gravity of the balls B may be varied in a random manner or a different specific gravity is intentionally set for selected ball or balls, so as to impart specific characteristics to independent game machines.

Obviously, the guide rail 422, which is composed of a pair of pipes, may be substituted by a trough-like member having a semi-circular or an arcuate cross-section.

Although the sensor elements used in the reading sections 5, 5' are magnetic sensors, it is possible to use optical sensors in place of such magnetic sensors. In such a case, optically sensible codes are formed in various directions, e.g., in three orthogonal directions, on the surface of each ball B, so that the codes can safely be read regardless of the orientation of the ball B in a proximal manner by a sensor such as, for example, a CCD scanner. It is also possible to form a specific optically readable pattern on the surface of the ball, the read pattern being then converted into the information peculiar to the ball, i.e., the numeral and the color.

Although the invention has been described through its preferred forms, it is to be understood that the described embodiments are only illustrative and various changes and modifications may be imparted thereto without departing from the scope of the invention which is limited solely by the appended claims.

What is claimed is:

1. A game machine of the type in which a plurality of M pieces are extracted in a random manner out of a plurality N pieces and (M<N), each of said N pieces carrying information peculiar thereto, and scores are gained in accordance with the conditions created by the combination of pieces of information carried by the extracted pieces, said game machine comprising:

tank means having a tank with a transparent wall and containing said N pieces and containing a liquid suspending said N pieces;

liquid circulation generating means for generating a vertical circulation of said liquid in said tank; and information reading means disposed in said tank at a portion of a plane which intersects the path of circulation of the liquid, and for extracting a piece to read the information carried by said piece when said piece passes said portion of said plane.

2. A game machine according to claim 1, wherein each piece has peculiar information transmitting means embedded therein, and said reading means has a proximity sensor capable of sensing the information peculiar to each piece transmitted by said information transmitting means.

3. A game machine according to claim 2, wherein said peculiar information transmitting means includes at least two identical information carriers which are arranged to extend in orthogonal directions so that information is sensed from one of said information carriers depending on the posture of said piece passing through said reading means.

4. A game machine according to claim 3, wherein said peculiar information transmitting means includes three information carriers arranged in three orthogonal directions.

5. A game machine according to claim 1, further comprising means for returning said piece to the circulating liquid after the reading of said information.

6. A game machine according to claim 1, wherein said N pieces has a specific gravity smaller than that of said liquid, and wherein said liquid circulation generating means includes means for producing a downward flow of said liquid in said tank.

7. A game machine according to claim 1, wherein said peculiar information includes at least one of color and numeral peculiar to each piece.

8. A game machine according to claim 1, wherein at least one of said N pieces has a specific gravity different from that of another piece.

9. A game machine according to claim 1, further comprising means for allowing the extracted piece to stay in said information reading means for a predetermined period of time.

10. A game machine according to claim 1, wherein said specific information is magnetically readable.

11. A game machine according to claim 1, wherein said specific information is optically readable.

12. A game machine according to claim 1, further comprising means for illuminating the interior of said tank.

13. A game machine of the type in which a plurality of M pieces are extracted in a random manner out of a plurality N pieces and (M<N), each of said N piece carrying information peculiar thereto, and scores are gained in accordance with the conditions created by the combination of pieces of information carried by the extracted pieces, said game machine comprising:

tank means having a tank with a transparent wall and containing said N pieces and containing a liquid having a specific gravity smaller than that of said N piece;

liquid circulation generating means for generating a circulation of said liquid such that an upward flow of said liquid is formed on a portion of the bottom of said tank so that the pieces staying on the bottom of said tank are forcibly conveyed upward by the upward flow of the liquid and then falls down through a region around said upward flow; and information reading means disposed in said tank at a portion of said region around said upward flow, and for extracting a piece to read the information carried by said piece when said piece passes said portion of said region.

14. A game machine according to claim 13, wherein said liquid circulation generating means includes an upward flow passage tube disposed on the center of the bottom of said tank and defining a passage for the upward flow of said liquid, and a liquid supply means for forcing the liquid into said upward flow passage tube through the lower end of said upward flow passage tube.

15. A game machine according to claim 14, wherein said liquid supply means has a pump which sucks said liquid from said region around said upward flow passage tube and forces the sucked liquid into said upward flow passage tube.

16. A game machine according to claim 14, further comprising anti-jump member disposed above said upward flow passage, for preventing said pieces from jumping above the surface of said liquid.

17. A game machine according to claim 14, further comprising: an annular protrusion formed on the bottom of said tank where said pieces are collected, so as to be concentric with said upward flow passage tube, thus holding said pieces slightly above said bottom, and a circular row of small holes provided around said protrusion and communicating with said liquid supply portion, so as to apply upward flow of the liquid to said pieces from the lower side of said pieces.

18. A game machine according to claim 17, wherein said annular protrusion is a circumferentially continuous protrusion.

19. A game machine according to claim 17, wherein said annular protrusion is formed of a plurality of discrete segments arranged said circle.

20. A game machine according to claim 13, further comprising a spiral guide member disposed between said transparent wall of said tank and the wall of said upward flow passage tube and progressively changing its diameter from the top to the bottom ends thereof.

21. A game machine according to claim 20, wherein said object is a ball, and said spiral guide member includes a pair of coaxial spiral linear members which are spaced from each other by a distance not greater than the diameter of said ball.

22. A game machine according to claim 21, wherein the diameter of said guide member varies such that the difference in diameter between two adjacent turns of the spiral form is substantially the same as the distance between said two spiral linear members.

23. A game machine according to claim 20, wherein said spiral guide member is rotatable about its axis which extends vertically.

24. A game machine according to claim 23, wherein said reading means includes at least one reading unit arranged along the path of rotation of the lower end of said spiral guide member such that said reading unit can receive a piece freed from said lower end when said lower end has been rotated to a position where it opposes said reading unit.

25. A game machine according to claim 13, wherein said liquid circulation generating means includes an upward flow passage tube disposed on the center of the bottom of said tank and defining a passage for the upward flow of said liquid, and a liquid supply means for forcing the liquid into said upward flow passage tube through the lower end of said upward flow passage tube, said liquid supply means including a sub-tank selectively communicatable with said tank by means of valves such that said liquid is shiftable between said tank and said sub-tank.

* * * * *